US008103384B2

(12) United States Patent
Matsumoto et al.

(10) Patent No.: US 8,103,384 B2
(45) Date of Patent: Jan. 24, 2012

(54) AIR CONDITIONER

(75) Inventors: Takashi Matsumoto, Tokyo (JP); Shintaro Watanabe, Tokyo (JP); Hiroshi Kage, Tokyo (JP); Yoshikuni Kataoka, Tokyo (JP); Hiroshi Hirosaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 330 days.

(21) Appl. No.: 12/554,261

(22) Filed: Sep. 4, 2009

(65) Prior Publication Data

US 2010/0063636 A1 Mar. 11, 2010

(30) Foreign Application Priority Data

Sep. 10, 2008 (JP) ..... 2008-231799
Jun. 4, 2009 (JP) ..... 2009-135186

(51) Int. Cl.
*G06F 19/00* (2006.01)

(52) U.S. Cl. ..... 700/276; 454/256

(58) Field of Classification Search ..... 700/276; 454/256; 236/49.3, 51; 62/149
See application file for complete search history.

(56) References Cited

U.S. PATENT DOCUMENTS 5,165,465 A * 11/1992 Kenet ..... 165/11.1
5,180,333 A * 1/1993 Shyu ..... 454/319
5,326,028 A 7/1994 Kano et al.
5,331,825 A * 7/1994 Kim ..... 62/180
5,478,276 A 12/1995 Lee
5,637,040 A 6/1997 Kim et al.
6,715,689 B1 4/2004 Lee et al.
6,840,053 B2 * 1/2005 Lindner et al. ..... 62/140
2003/0199244 A1 10/2003 Siddaramanna et al.
2004/0050077 A1 * 3/2004 Kasai et al. ..... 62/186

FOREIGN PATENT DOCUMENTS

EP 1 798 494 A1 6/2007
JP 6-101892 B2 12/1994
JP 2707382 B2 1/1998
JP 3963937 B1 8/2007
WO WO 2008/152862 A1 12/2008

OTHER PUBLICATIONS

Extended Search Report from European Patent Office issued in corresponding European Patent Application No. 09011383.8 dated Dec. 21, 2010.

* cited by examiner

*Primary Examiner* — Kidest Bahta
(74) *Attorney, Agent, or Firm* — Buchanan Ingersoll & Rooney PC

(57) ABSTRACT

An air conditioner provided with a spatial recognition and detection function for deciding the room shape by integrally determining based on a temperature difference information between the floor and the walls occurring during the air conditioning operation, a human body detection position log, and a capacity zone of the air conditioner. The air conditioner provides an infrared sensor and a control unit that controls the air conditioner by detecting a presence of heat generating device and human with the infrared sensor, wherein the control unit acquires a thermal image data of the room by scanning with the infrared sensor, and integrates to calculate a floor dimension inside the air conditioning area, and calculates the wall position within the air conditioning area on the thermal image data.

14 Claims, 48 Drawing Sheets

Fig. 9

| CAPACITY [kw] | COOLING(APPROXIMATE NUMBER OF MATS) [MAT] | DIMENSION (AREA) [m²] |
|---|---|---|
| 2．2 | 6～9 | 10～15 |
| 2．5 | 7～10 | 11～17 |
| 2．8 | 8～12 | 13～19 |
| 3．6 | 10～15 | 16～25 |
| 4 | 11～17 | 18～28 |
| 5 | 14～21 | 23～34 |
| 6．3 | 17～26 | 29～43 |
| 7．1 | 20～30 | 32～49 |

Fig.10

| CAPACITY [kw] | LENGTH * BREADTH (m) 2 : 1 | LENGTH * BREADTH (m) 1 : 1 | LENGTH * BREADTH (m) 1 : 2 |
|---|---|---|---|
| 2.2 | 5.5 * 2.7 | 3.9 * 3.9 | 2.7 * 5.5 |
| 2.5 | 5.8 * 2.9 | 4.1 * 4.1 | 2.9 * 5.8 |
| 2.8 | 6.2 * 3.1 | 4.4 * 4.4 | 3.1 * 6.2 |
| 3.6 | 7.1 * 3.5 | 5.0 * 5.0 | 3.5 * 7.1 |
| 4 | 7.5 * 3.7 | 5.3 * 5.3 | 3.7 * 7.5 |
| 5 | 8.2 * 4.1 | 5.8 * 5.8 | 4.1 * 8.2 |
| 6.3 | 9.3 * 4.6 | 6.6 * 6.6 | 4.6 * 9.3 |
| 7.1 | 9.9 * 4.9 | 7.0 * 7.0 | 4.9 * 9.9 |

Fig.12

| CAPACITY [kw] | AREA [m²] | MINIMUM VALUE [m] | MAXIMUM VALUE [m] | INITIAL VALUE [m] |
|---|---|---|---|---|
| 2．2 | 10～15 | 2．7 | 5．4 | 3．5 |
| 2．5 | 11～17 | 2．9 | 5．8 | 3．7 |
| 2．8 | 13～19 | 3．1 | 6．2 | 4．0 |
| 3．6 | 16～25 | 3．5 | 7．1 | 4．5 |
| 4 | 18～28 | 3．7 | 7．5 | 4．8 |
| 5 | 23～34 | 4．1 | 8．2 | 5．3 |
| 6．3 | 29～43 | 4．6 | 9．3 | 6．0 |
| 7．1 | 32～49 | 4．9 | 9．9 | 6．4 |

EXE. DIMENSION OF INITIAL ROOM SHAPE AT CAPACITY =2.2kW

AIR CONDITIONER

BACKGROUND OF THE INVENTION

1. Field of the Invention

The present invention relates to an air conditioner.

2. Description of the Related Art

The air conditioner can increase an amenity on human present inside a room by utilizing information such as a room capacity and floor and wall temperatures etc., for example, by controlling a temperature, a wind direction and an air volume. The air conditioner can automatically perform a pleasant air conditioning operation.

In case of detecting the room capacity and the floor and wall temperatures by using a two-dimensional thermal image data detected by a pyroelectric type infrared sensor, as a conventional commonly-used method, there is a method of calculating them after detecting a wall and floor boundary in the room by an image processing or an image recognition of an image data read from an image inputting apparatus.

For example, a thermal image data detected by the image inputting unit is stored on a thermal image data storing unit. The thermal image data stored therein is converted to a line image data by an edge and line detecting means. The line image data, in a boundary calculating unit for the walls and the floor inside the room, is used for calculating positions of the walls and the floor in the two-dimensional thermal image data. The room capacity and the floor and wall temperatures are calculated based on the thermal image data stored on the thermal image data storing unit and the calculated information.

However, in a conventional room information detecting apparatus, when the wall and floor boundary cannot be favorably calculated by the two-dimensional infrared ray thermal image data, the positions of floor and walls cannot be calculated accurately either, so that it is difficult, in terms of a pattern recognition processing, to calculate the positions of floor and walls for an unknown room based on the calculated line image data.

Thus, in attempt to solve the conventional problem such as this, and for easily providing an excellent indoor information detecting apparatus that can calculate the room capacity and the floor and wall temperatures by effectively using information on the human inside the room, the indoor information detecting apparatus is being proposed, that provides an image inputting unit for detecting the two-dimensional thermal image information inside the room, a thermal image data storing means, a human area detecting means, a means for calculating a representative point showing a human position, a storing means for cumulatively storing the representative point, a position detecting means for the room capacity and the floor and walls inside the room, and a temperature calculating means for the floor and walls.

With the above configuration, for example, the patent document 1 discusses the room information detecting device, that utilizes a fact of readily detecting a human position inside the room based on the thermal threshold value by detecting the thermal image data for inside room to calculate the human position from the two-dimensional infrared ray image (the thermal image) data, cumulates and stores a movement area of the human position, and calculates walls and floor positions inside the room based on that information, and detects the room capacity and the floor and wall temperatures for inside the room from the walls and floor positions and the thermal image data. Accordingly, the inside room capacity and floor and wall temperatures are accurately and readily calculated.

[Patent Document 1] Japanese Patent Publication No. 2707382

However, the patent document 1 mentioned above does not disclose a space recognition technology for determining a room shape by integrally determining, based on an adaptive room condition in determining a floor, depending on a capacity zone, a temperature difference (temperature unevenness) between the floor and the walls occurring during the air conditioning operation, and a result of human body log.

The present invention attempts to solve the problem such as this, by providing an air conditioner having the spatial recognition and detection function for determining the room shape by integrally determining the temperature difference (temperature unevenness) information between the floor and the walls occurring during the air conditioning operation, a human body detection position log, and a capacity zone of the air conditioner.

SUMMARY OF THE INVENTION

According to one aspect of the present invention, an air conditioner comprises: a substantially box-shaped main body having an air suction port that sucks air of a room and an air outlet port that discharges conditioned air; an infrared sensor attached to a front of the main body at a prescribed downwardly facing depression angle that detects a temperature of a temperature detection target by scanning a temperature detection target area from right to left; and a control unit that controls the air conditioner by detecting a presence of human or heat generating device with the infrared sensor; and wherein the control unit acquires a thermal image data of the room by scanning with the infrared sensor, calculates on the thermal image data a floor dimension of an air conditioning area by integrating three information indicated below, and calculates wall positions in the air conditioning area on the thermal image data.

(1) a room shape having a shape limitation value and an initial setting value, which is calculated based on a capacity zone of the air conditioner and a remote controller installation position button setting;

(2) a room shape calculated based on a temperature unevenness of the floor and walls occurring during an operation of the air conditioner; and (3) a room shape calculated based on a human body detection position log.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 illustrates an approximate number of tatami mats and dimension (the area) during a cooling operation stipulated by a capacity zone of the air conditioner 100, in accordance with the first embodiment.

FIG. 10 shows a table that specifies the dimension (area) of the floor for each capacity, by utilizing the maximum area of the dimension (area) for each capacity described in FIG. 9, in accordance with the first embodiment.

FIG. 12 illustrates lengthwise and breadthwise distance conditions, worked out from the capacity zone of the air conditioner 100, in accordance with the first embodiment.

DETAILED DESCRIPTION OF THE EMBODIMENTS

First Embodiment

At first, an outline of the present embodiment will be described. The air conditioner (the indoor unit) provides an infrared sensor that detects a temperature while scanning the temperature detection target area. The infrared sensor detects a presence of heat generating device or human by performing a heat source detection. The air conditioner performs an ideal control accordingly.

Generally, the indoor unit is installed on a wall, at a higher position of the room. There are various positions where the indoor unit can be installed with respect to right and left positions on the wall. The indoor unit may be substantially installed at a mid-position of the wall in the right and left direction, or in some cases it may be installed close to the right side wall or the left side wall, when viewed from the indoor unit. Hereinafter, the right and left direction of the room is defined as the right and left direction viewed from the indoor unit (the infrared sensor 3).

Figure 1:
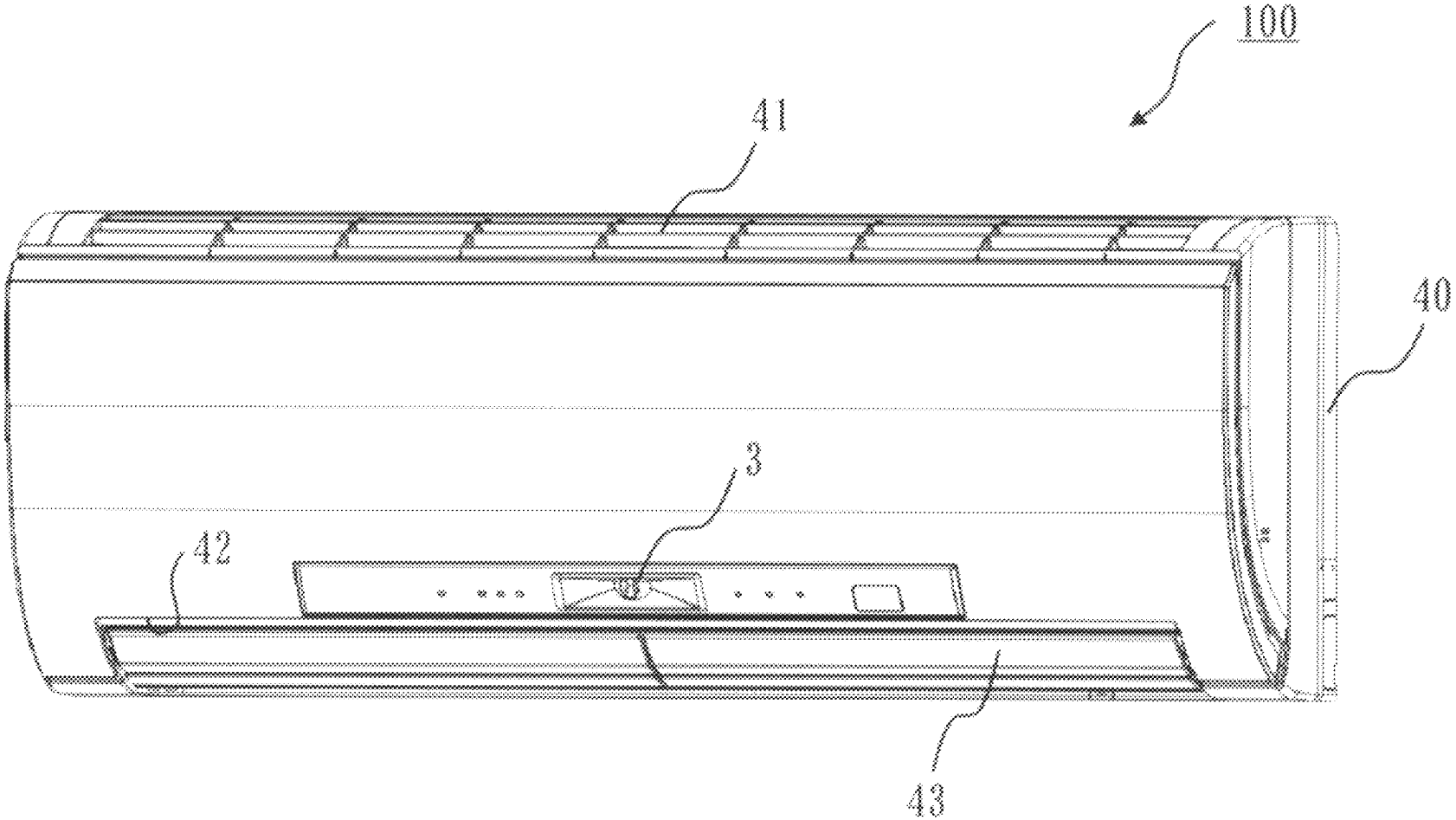
FIG. 1 is a perspective view of an air conditioner 100, in accordance with a first embodiment.
Figure 2:
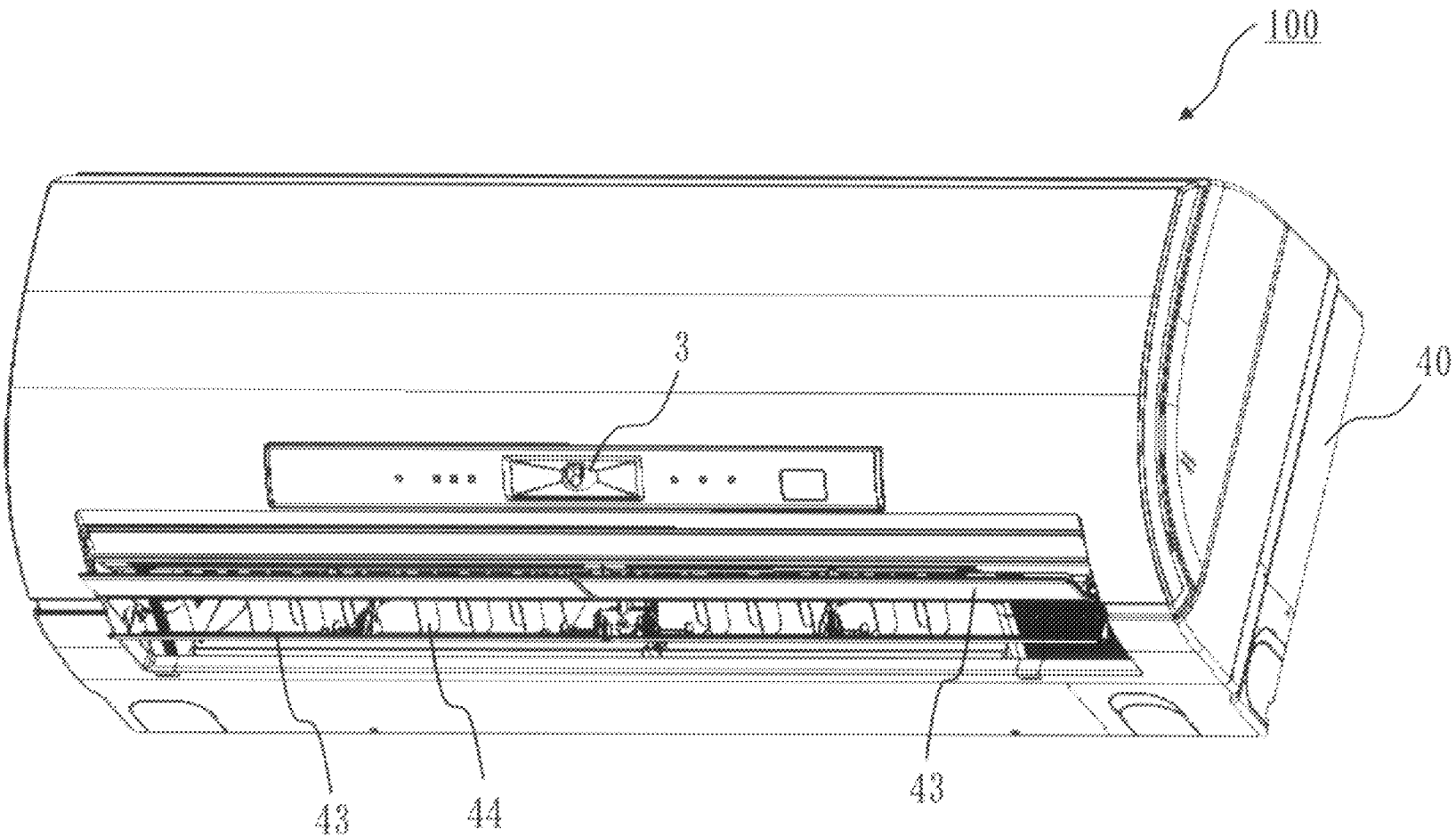
FIG. 2 is a perspective view of the air conditioner 100, in accordance with the first embodiment.
Figure 3:
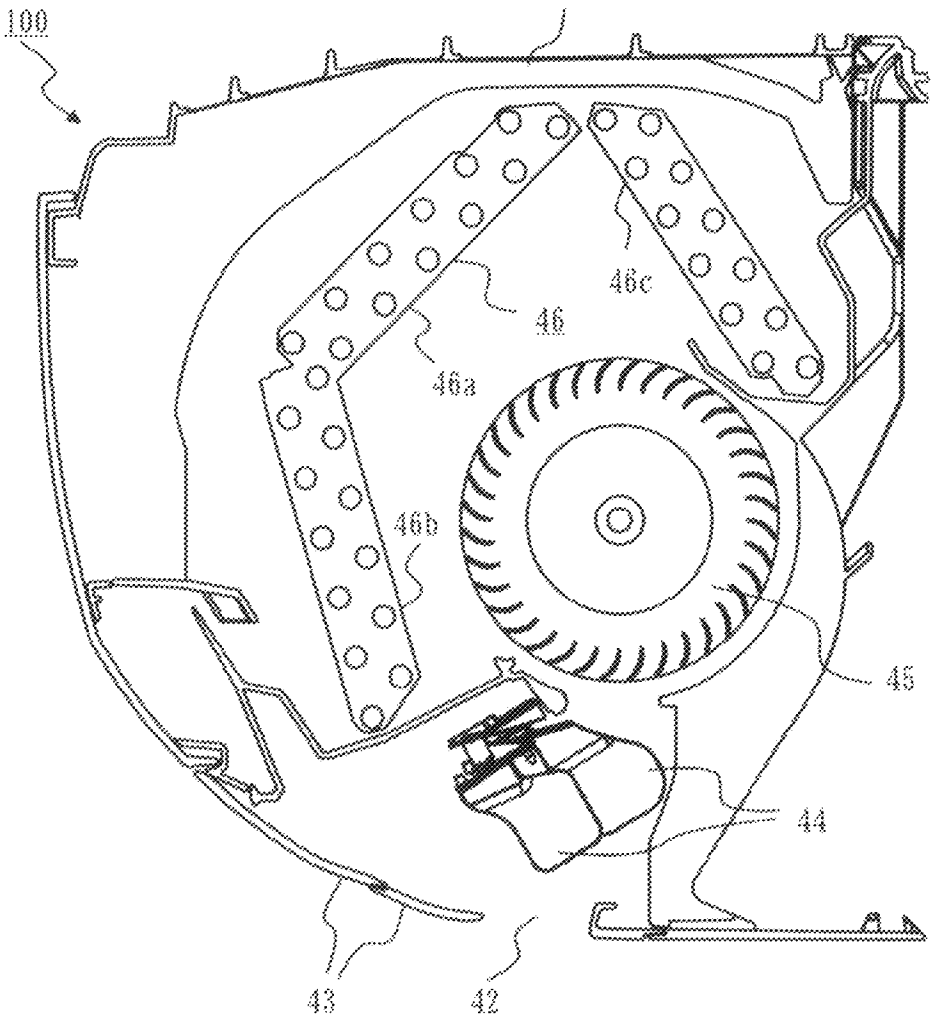
FIG. 3 is a longitudinal cross sectional view of the air conditioner 100, in accordance with the first embodiment.
Figure 4:
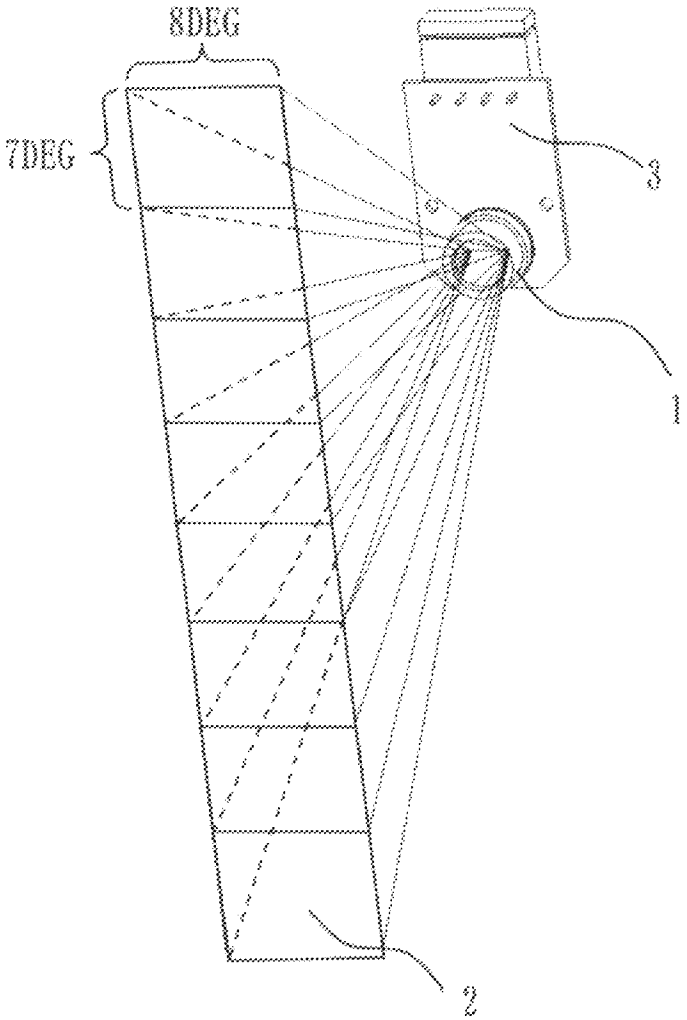
FIG. 4 illustrates the infrared sensor 3 and luminous intensity distribution angles of light receiving elements, in accordance with the first embodiment.
Figure 5:
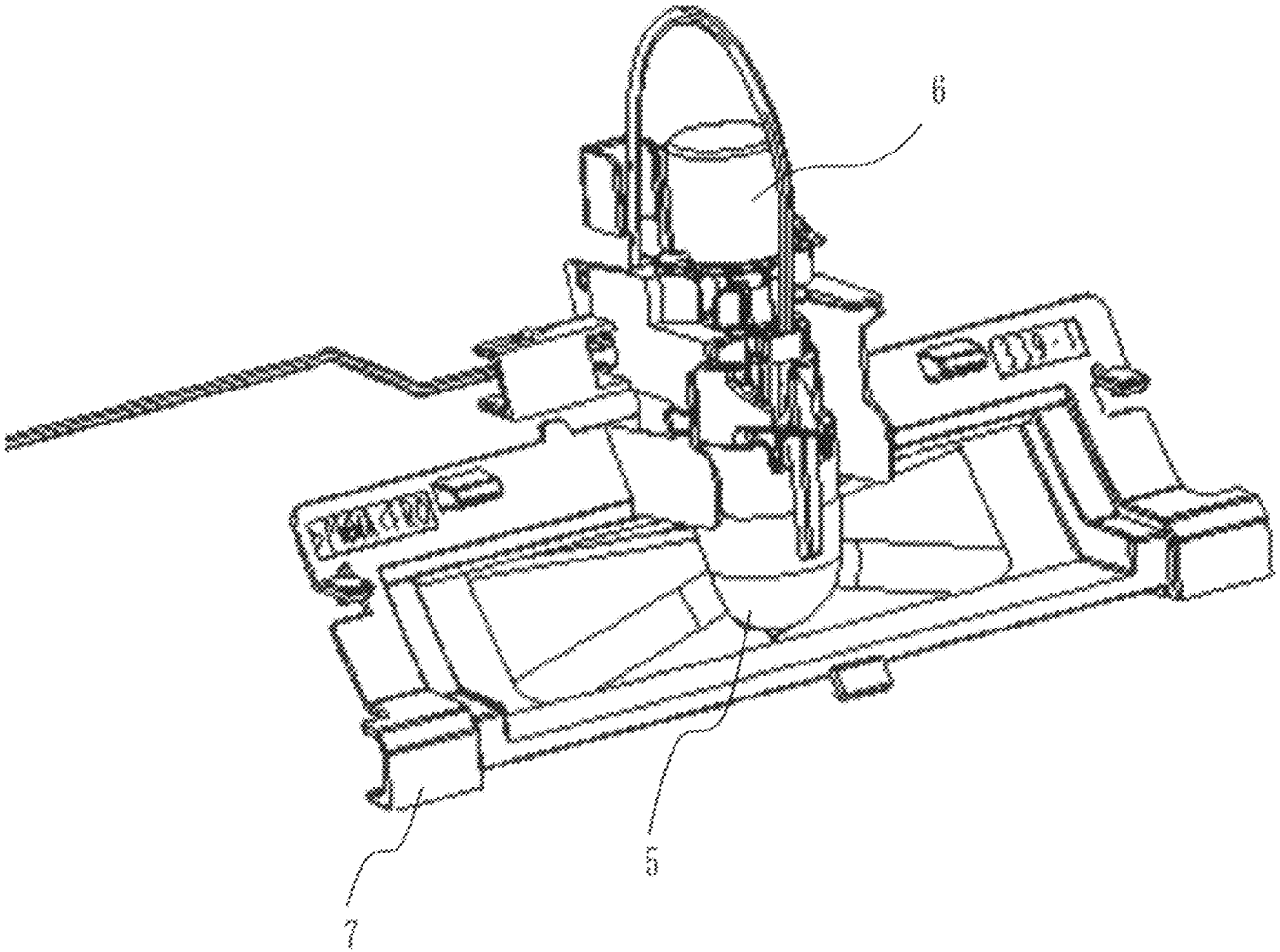
FIG. 5 is a perspective view of a chassis 5 for storing the infrared sensor 3, in accordance with the first embodiment.
Figure 6:
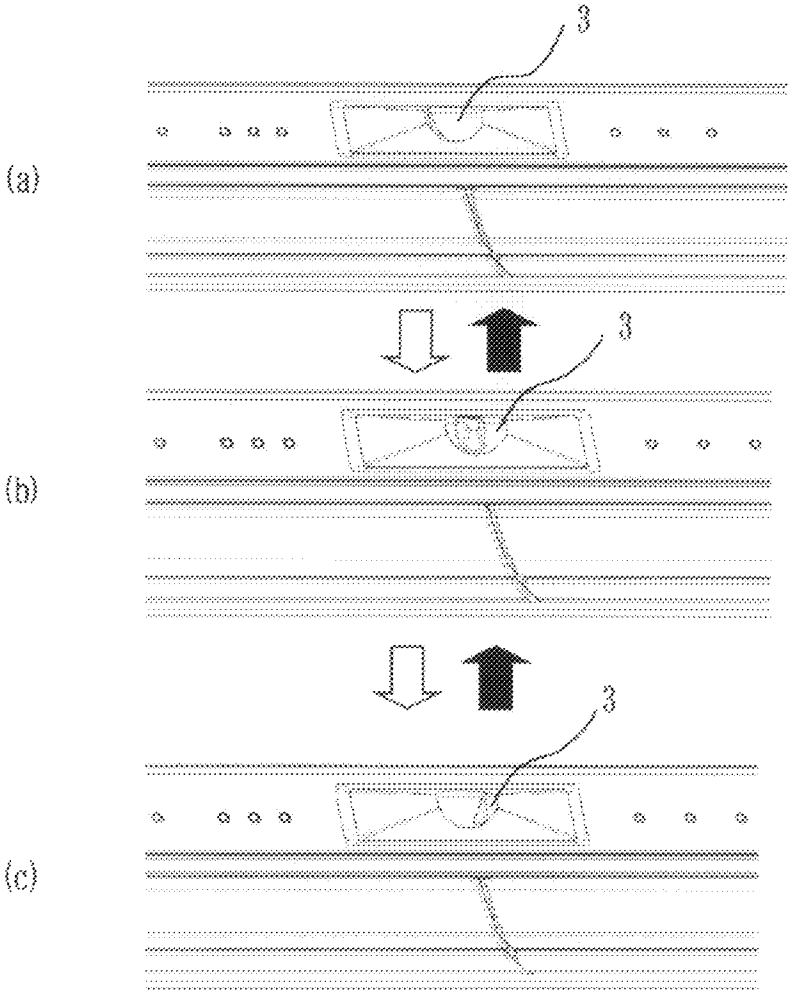
FIG. 6 is a perspective view of a vicinity of the infrared sensor 3, which shows (a) the infrared sensor 3 moving to a right edge unit, (b) the infrared sensor 3 moving to a central part, and (c) the infrared sensor 3 moving to a left edge unit, in accordance with the first embodiment.
Figure 7:
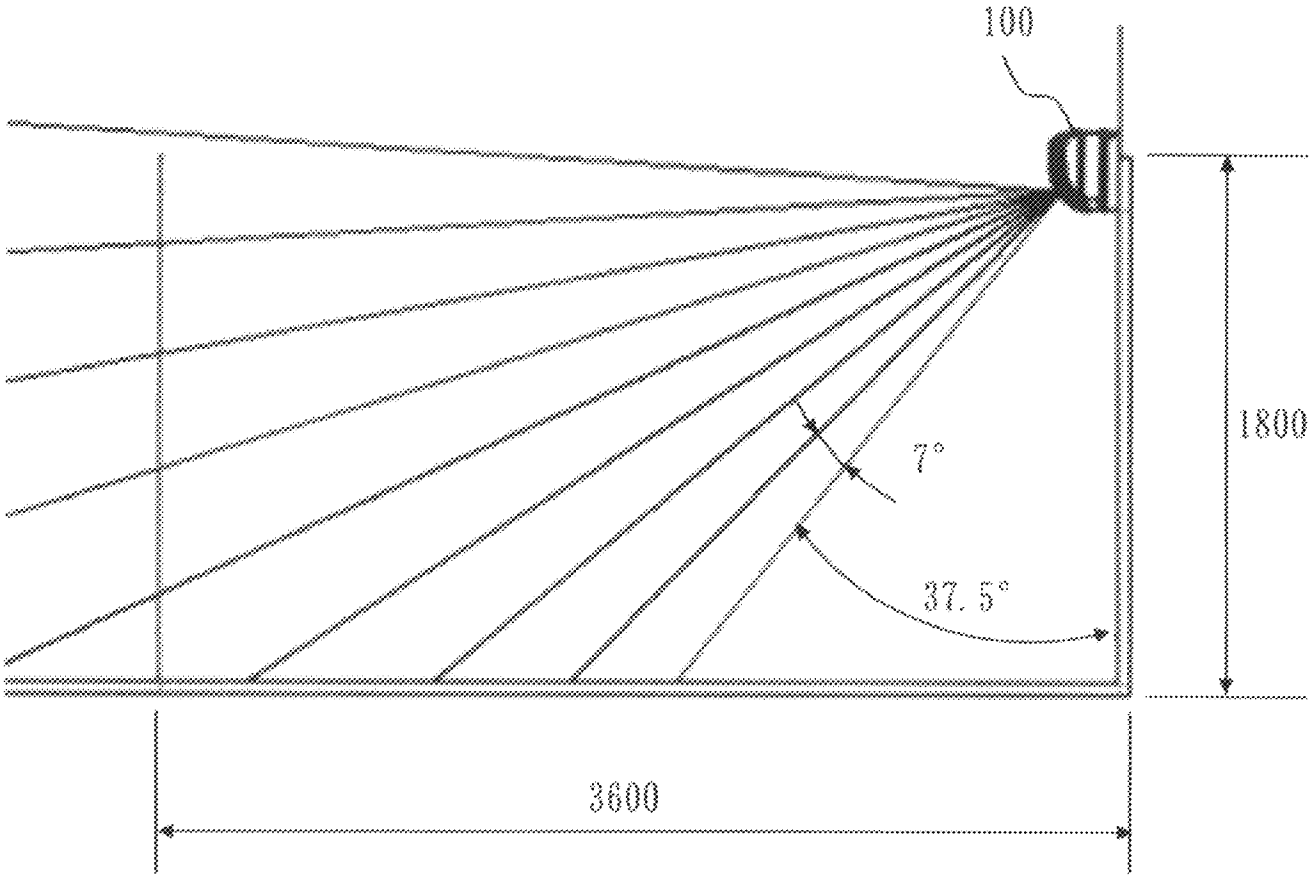
FIG. 7 illustrates a vertical luminous intensity distribution angle in a longitudinal cross section of the infrared sensor 3, in accordance with the first embodiment.
Figure 8:
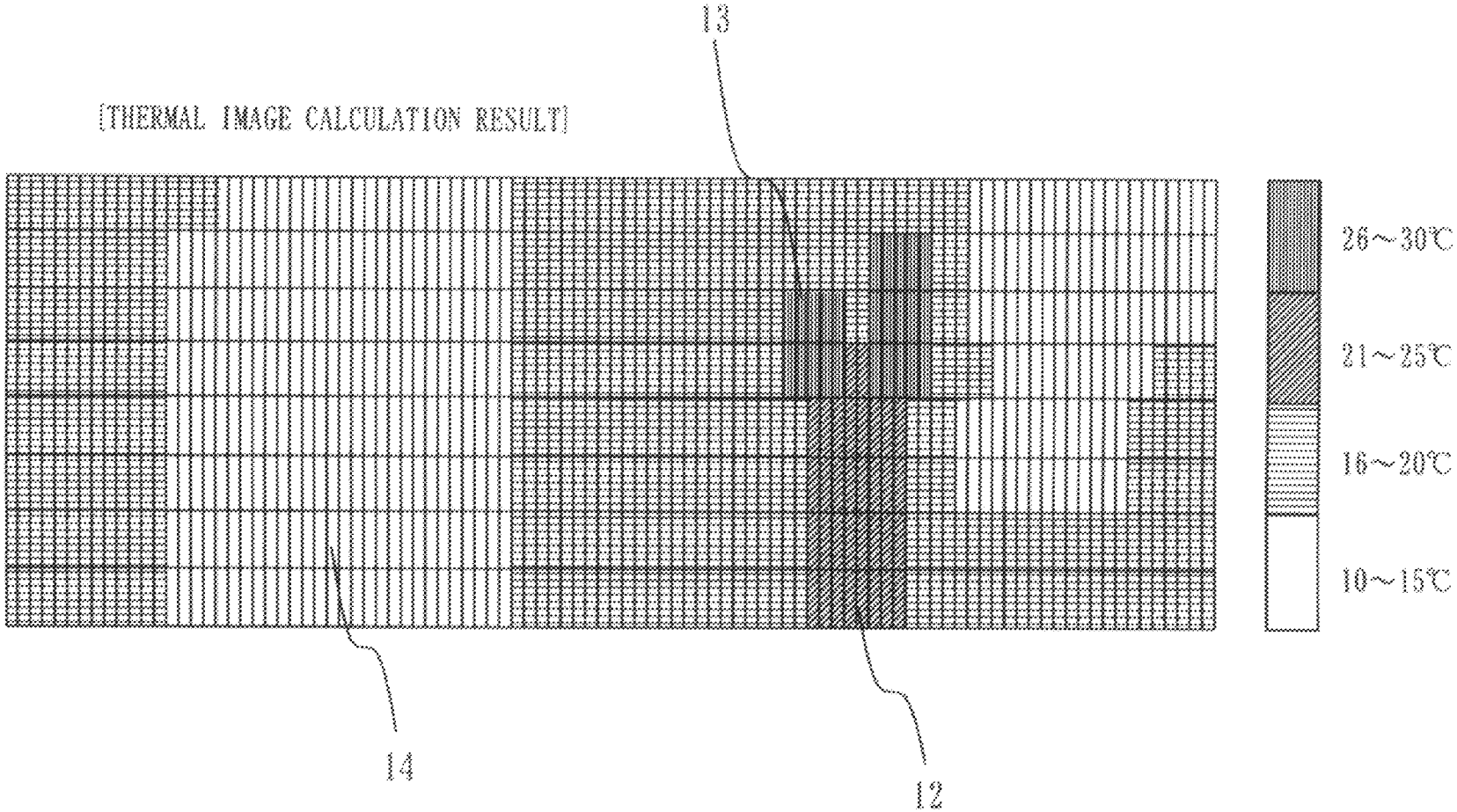
FIG. 8 illustrates a thermal image data of a room where a housewife 12 is holding a baby 13, in accordance with the first embodiment.
Figure 11:
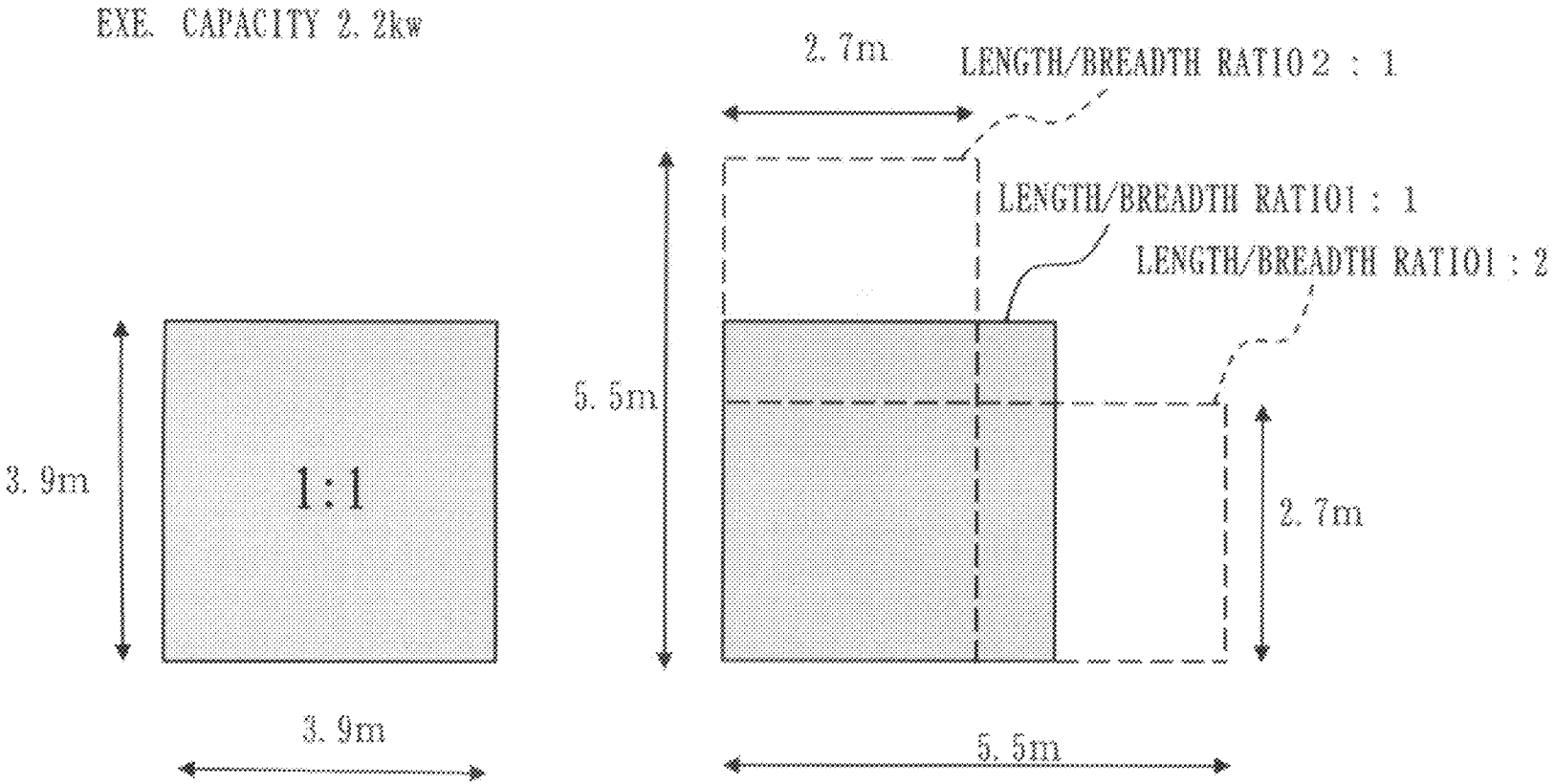
FIG. 11 illustrates a length and breadth, room shape limitation values, for a capacity of 2.2 kw, in accordance with the first embodiment.
Figure 13:
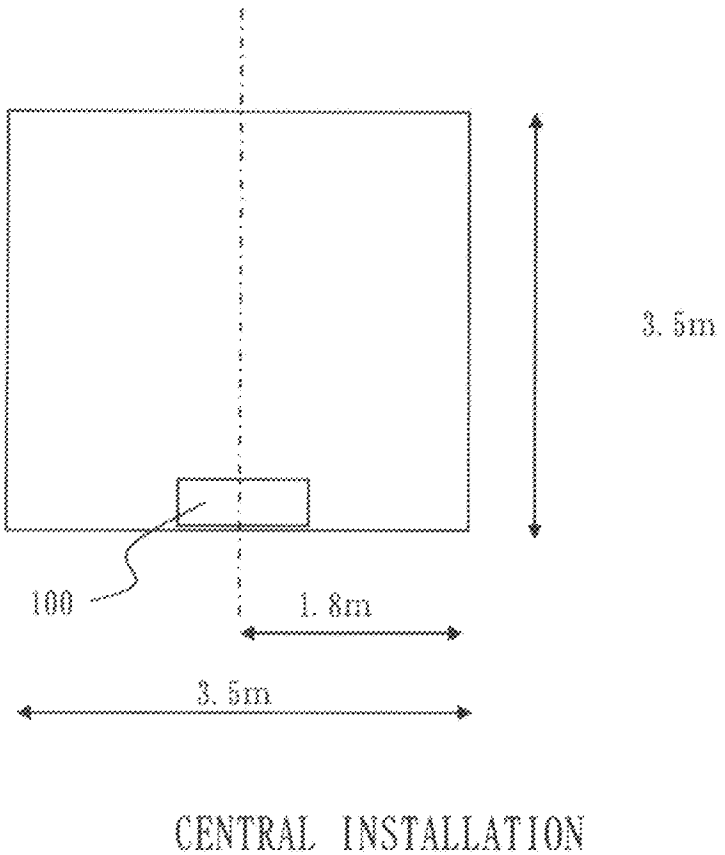
FIG. 13 illustrates a central installation condition for the capacity of 2.2 kw, in accordance with the first embodiment.
Figure 14:
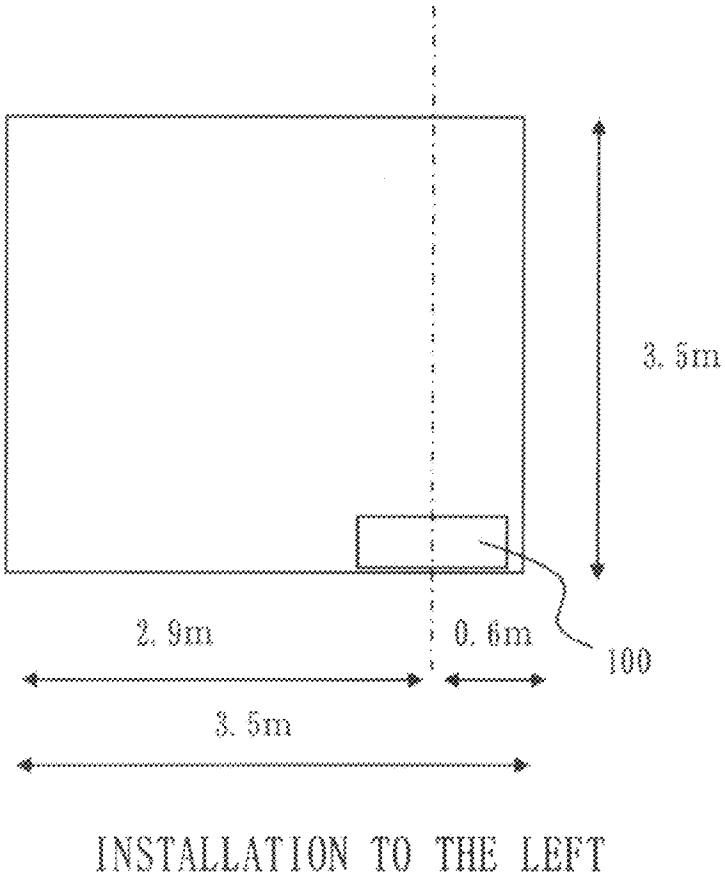
FIG. 14 shows a case of installation to the left corner (viewed from the user), for the capacity of 2.2 kw, in accordance with the first embodiment.
Figure 15:
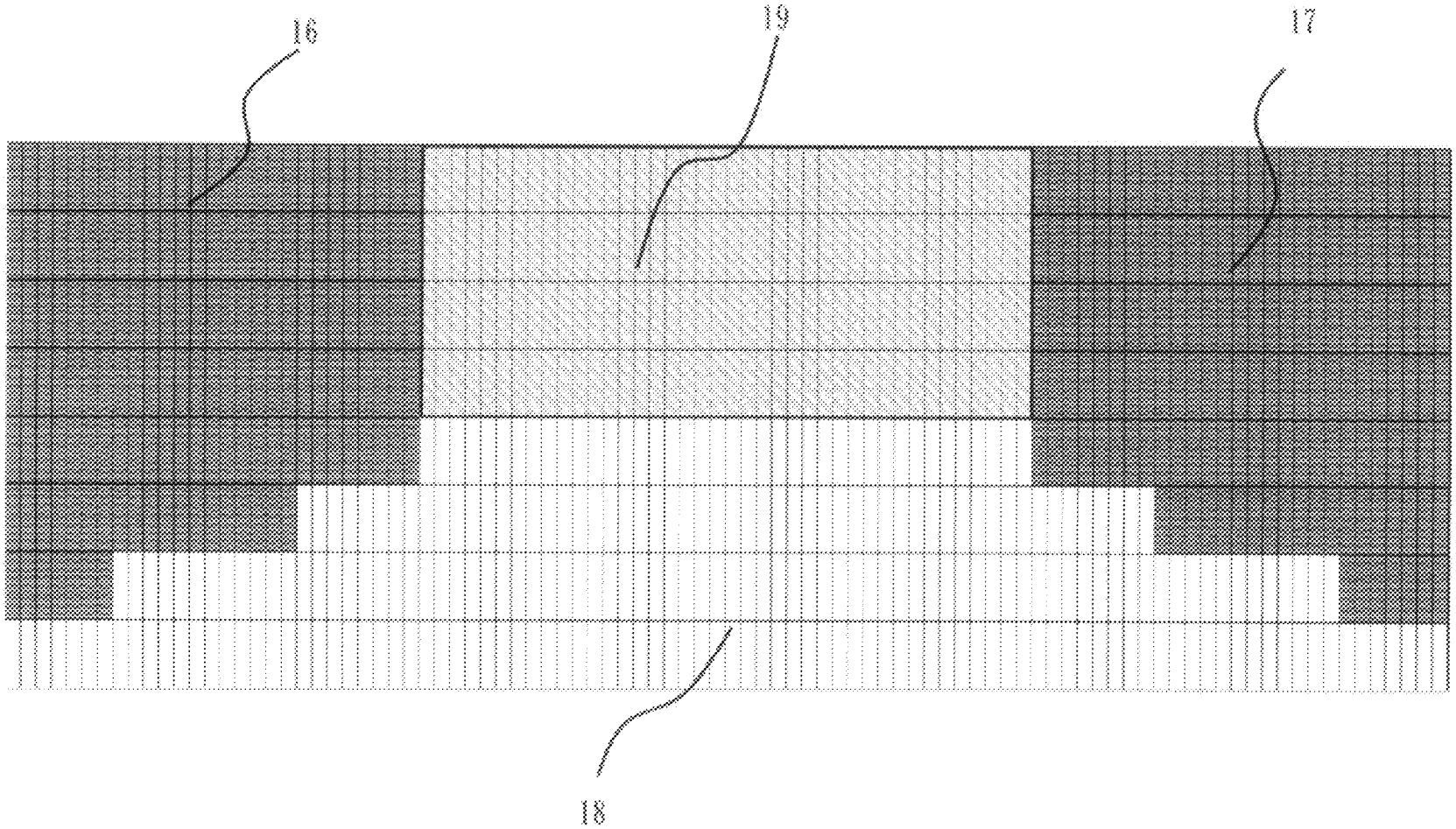
FIG. 15 illustrates a position relation between the floor and the walls on the thermal image data upon setting the remote controller installation position at the center, for the capacity of 2.2 kw of the air conditioner 100, in accordance with the first embodiment.
Figure 16:
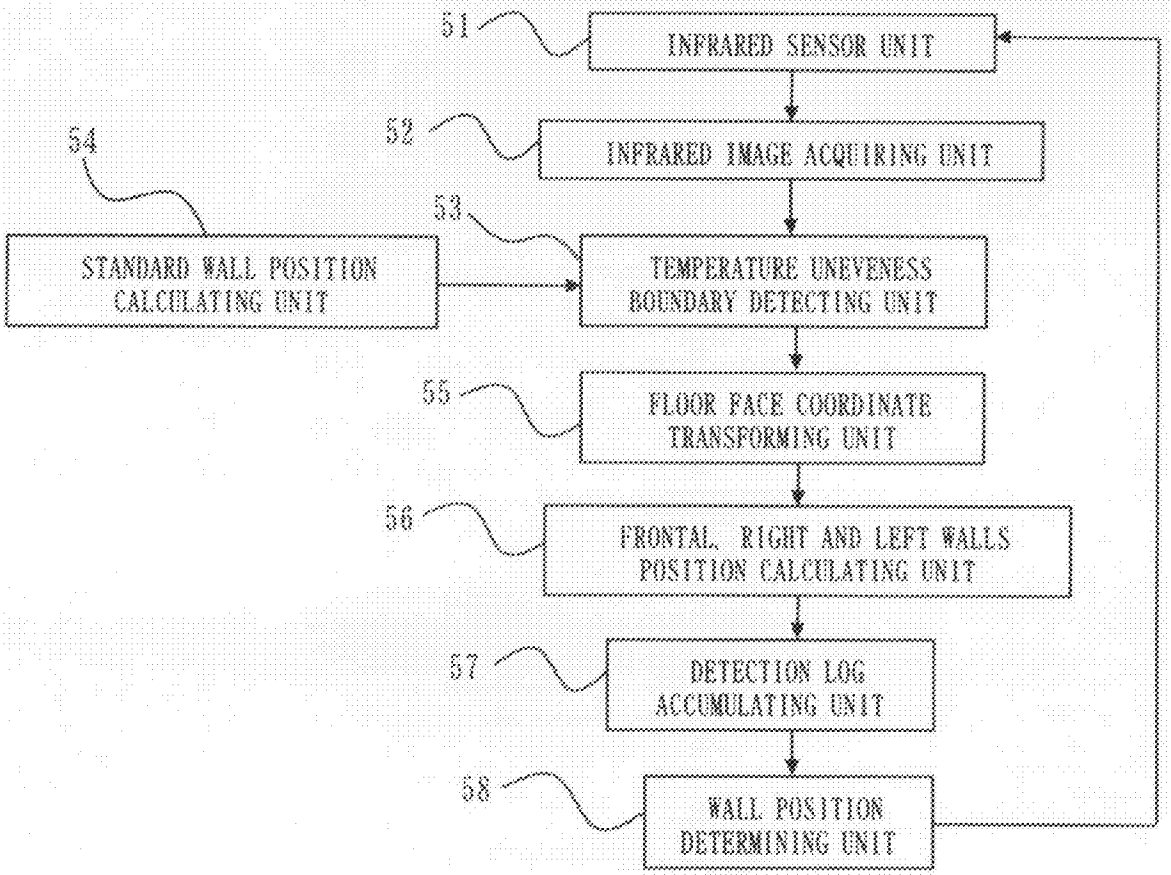
FIG. 16 illustrates a flow for calculating the room shape based on the temperature unevenness, in accordance with the first embodiment.
Figure 17:
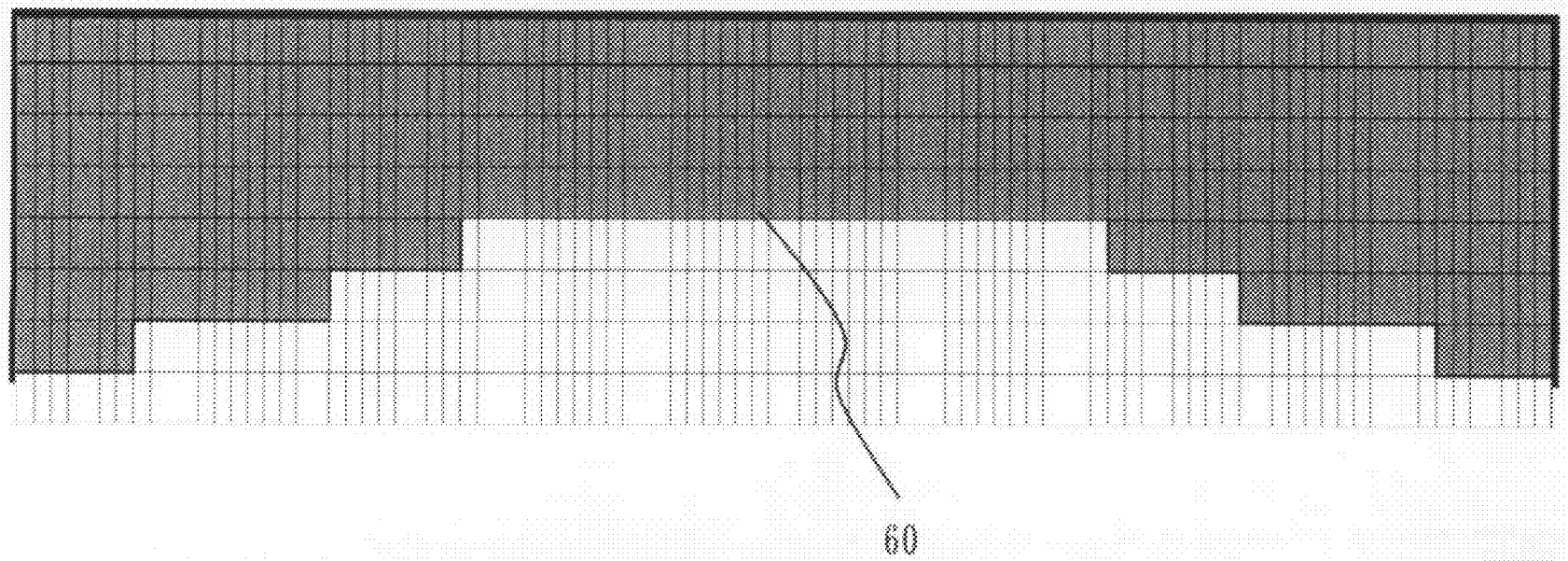
FIG. 17 illustrates upper and lower pixels serving as a boundary between the wall and the floor on the thermal image data of FIG. 15, in accordance with the first embodiment.
Figure 18:
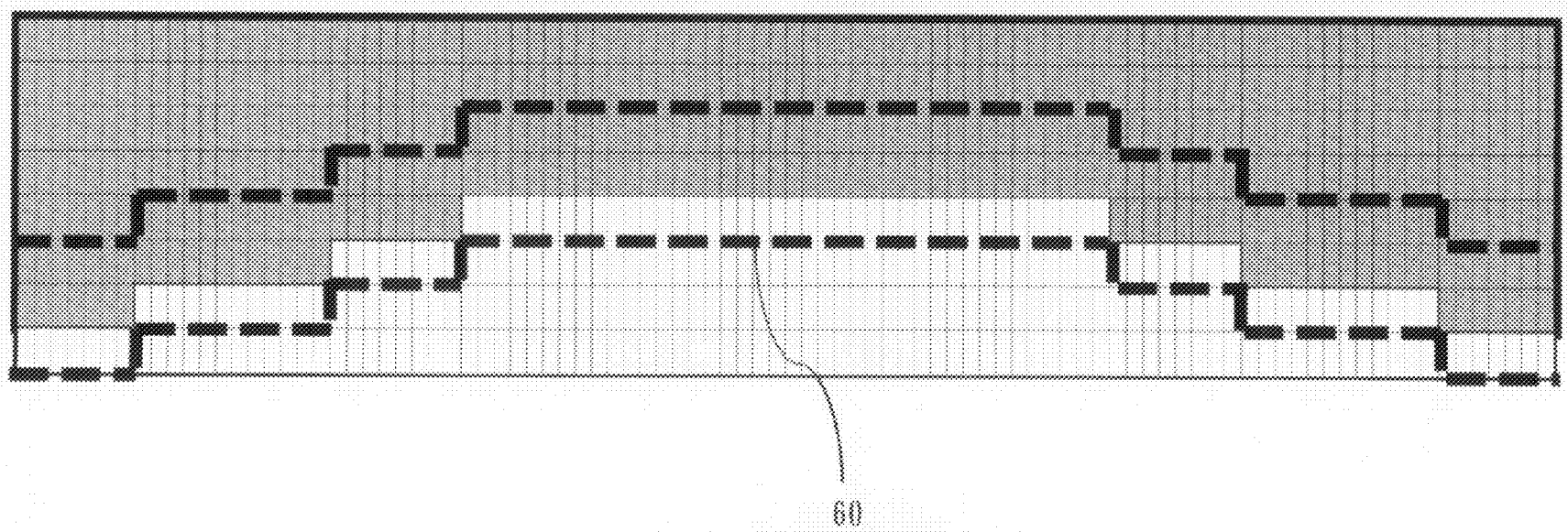
FIG. 18 is a drawing for detecting a temperature arising between the upper and lower pixels including 1 pixel in a lower direction and 2 pixels in an upper direction (3 pixels in total), in respect to the position of a boundary line 60 set at FIG. 17, in accordance with the first embodiment.
Figure 19:
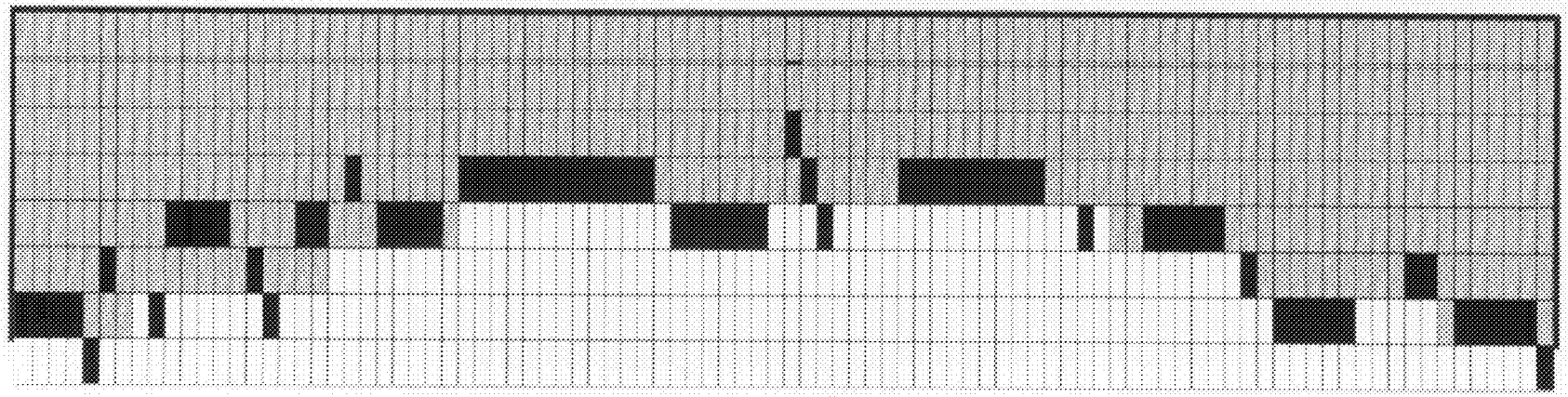
FIG. 19 is a drawing showing pixels that exceeded the threshold value and pixels exceeding a maximum value of inclination detected by a temperature unevenness boundary detecting unit 53 for detecting the temperature unevenness boundary in a pixel detection area, are marked in black, in accordance with the first embodiment.
Figure 20:
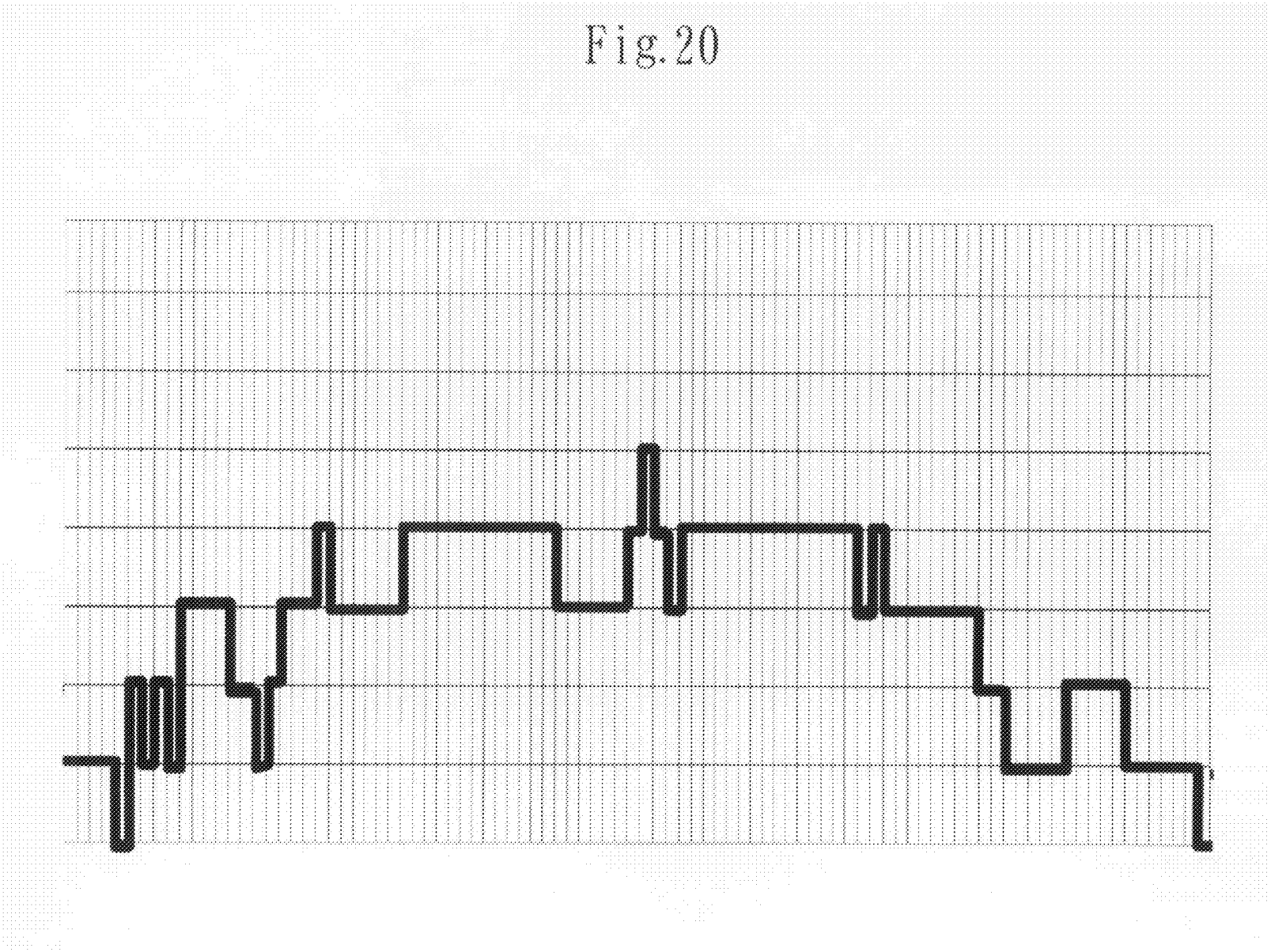
FIG. 20 illustrates a result of detecting the boundary line based on the temperature unevenness, in accordance with the first embodiment.
Figure 21:
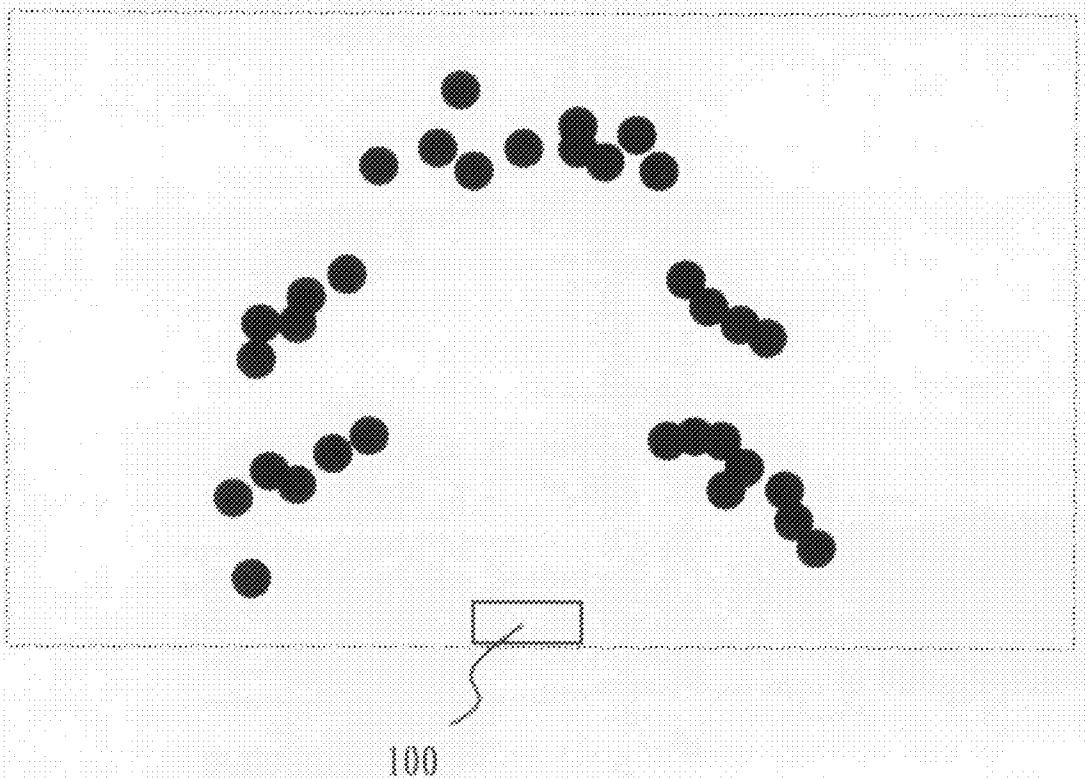
FIG. 21 illustrates a result of transforming a coordinate point (X, Y) of each element drawn at a lower part of the boundary line as a floor coordinate point by a floor coordinate transforming unit 55, on the thermal image data, and projecting onto the floor 18, in accordance with the first embodiment.
Figure 22:
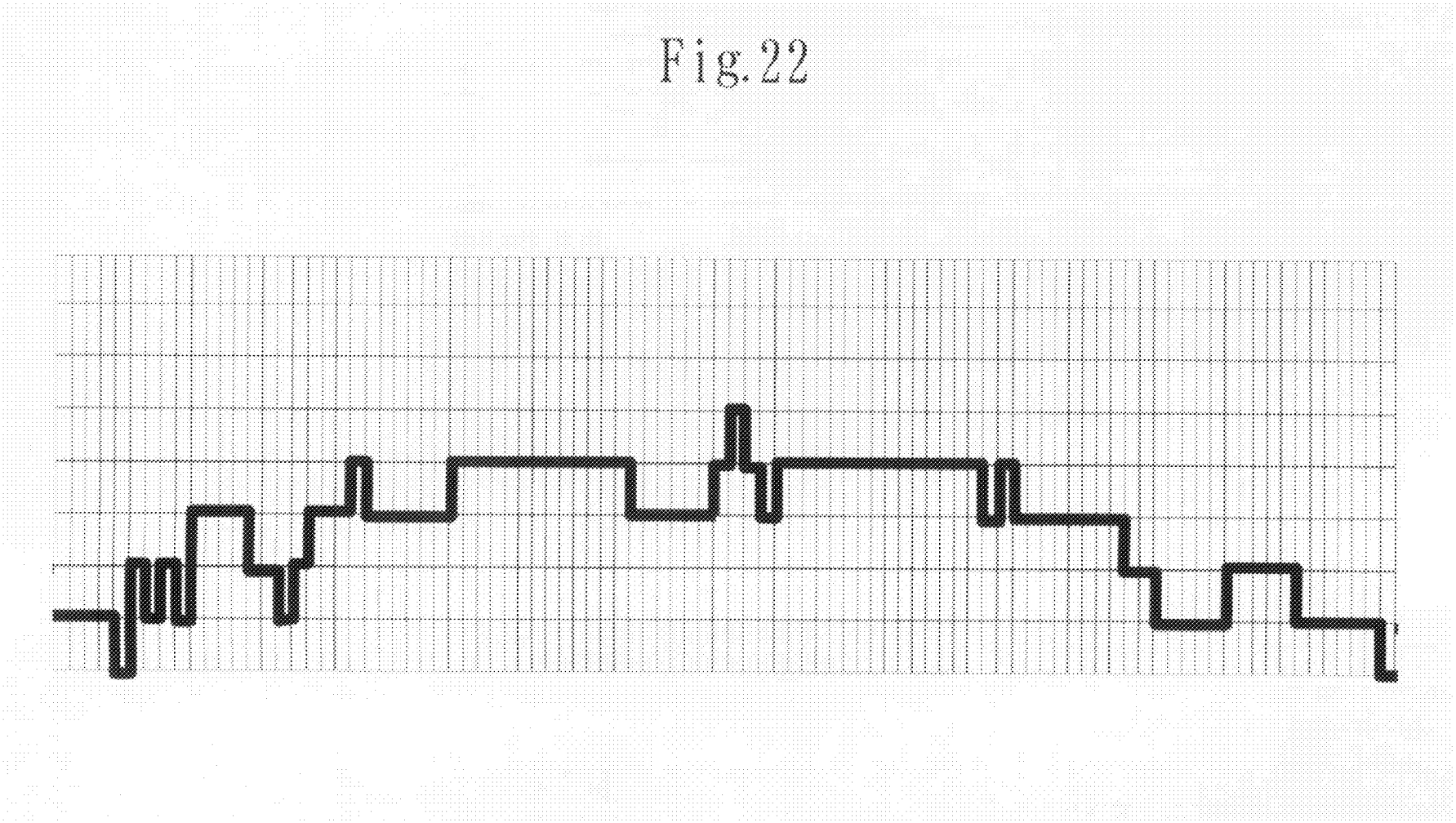
FIG. 22 illustrates an area of pixel targeted for detecting the temperature difference around the position of a frontal wall 19 under the initial setting condition in the remote controller central installation condition, at the capacity of 2.2 kw, in accordance with the first embodiment.
Figure 23:
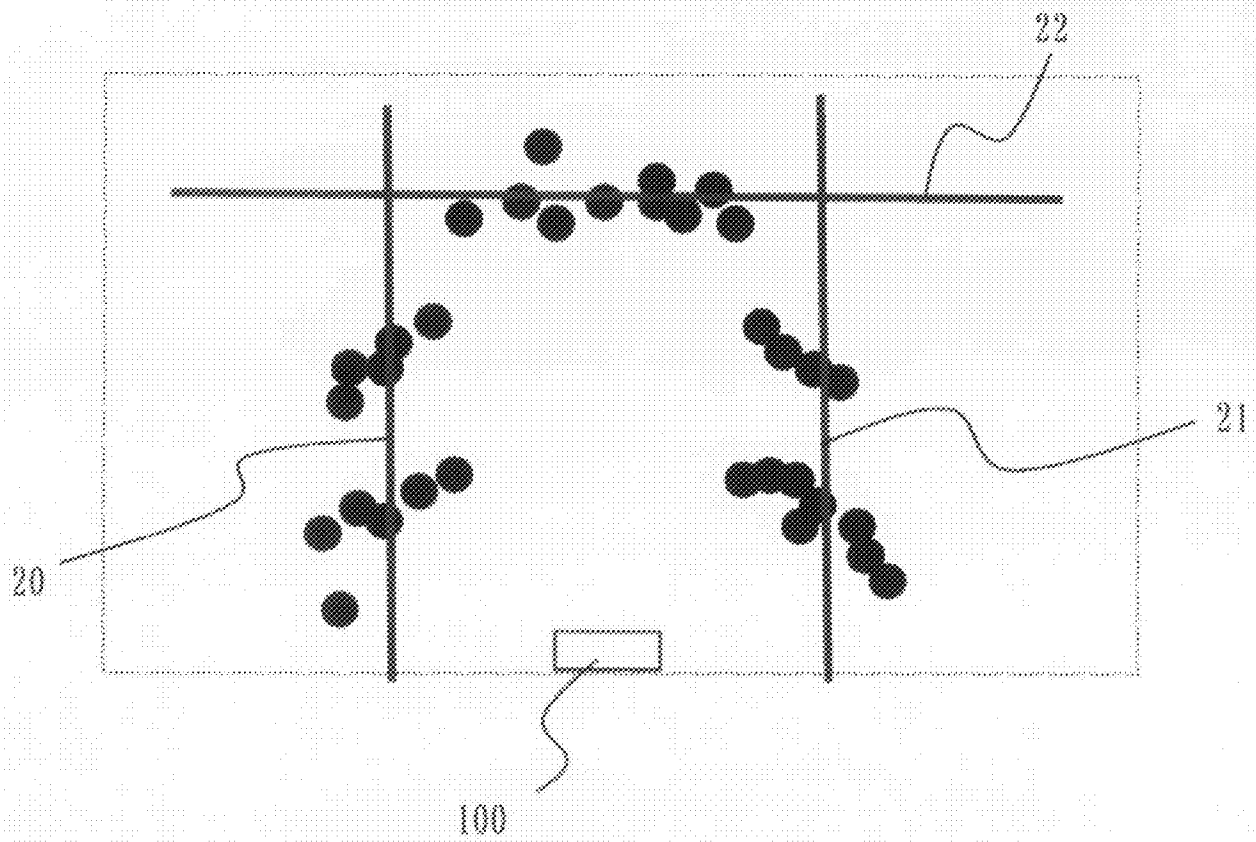
FIG. 23 is a drawing for calculating a wall position for the frontal wall 19 and the floor 18 by working out an average of the distribution element coordinate point of each element for detecting a vicinity of the floor wall 19 shown in FIG. 22, in terms of FIG. 21 that projected the boundary line element coordinate of each thermal image data on the floor 18, in accordance with the first embodiment.
Figure 24:
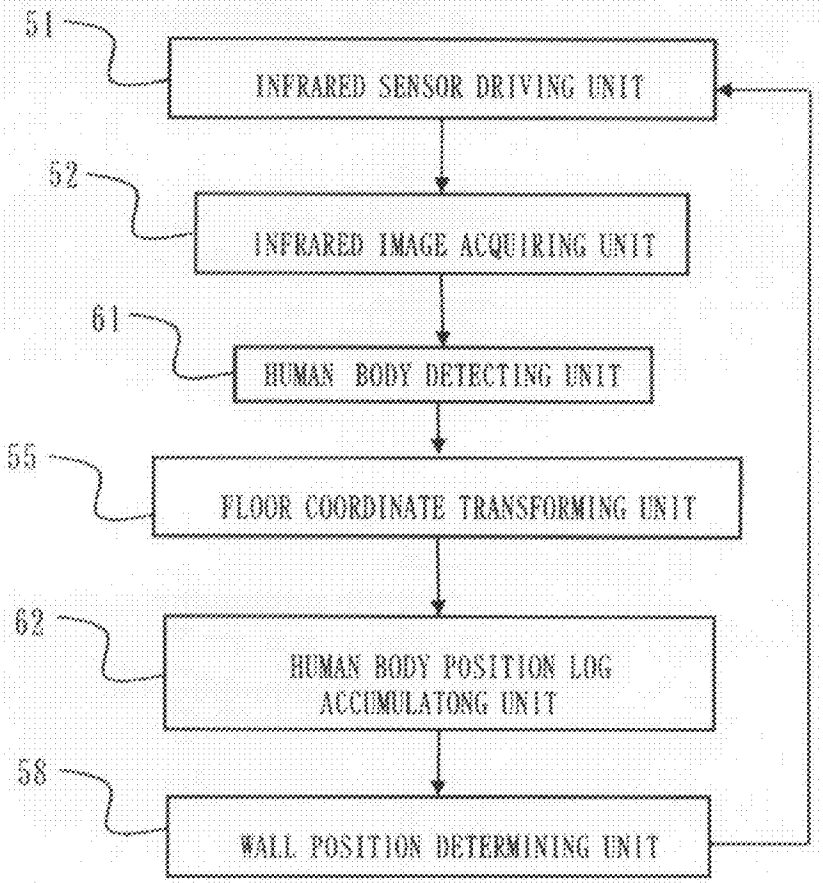
FIG. 24 is a flow for calculating a room shape based on the human body detection position log, in accordance with the first embodiment.
Figure 25:
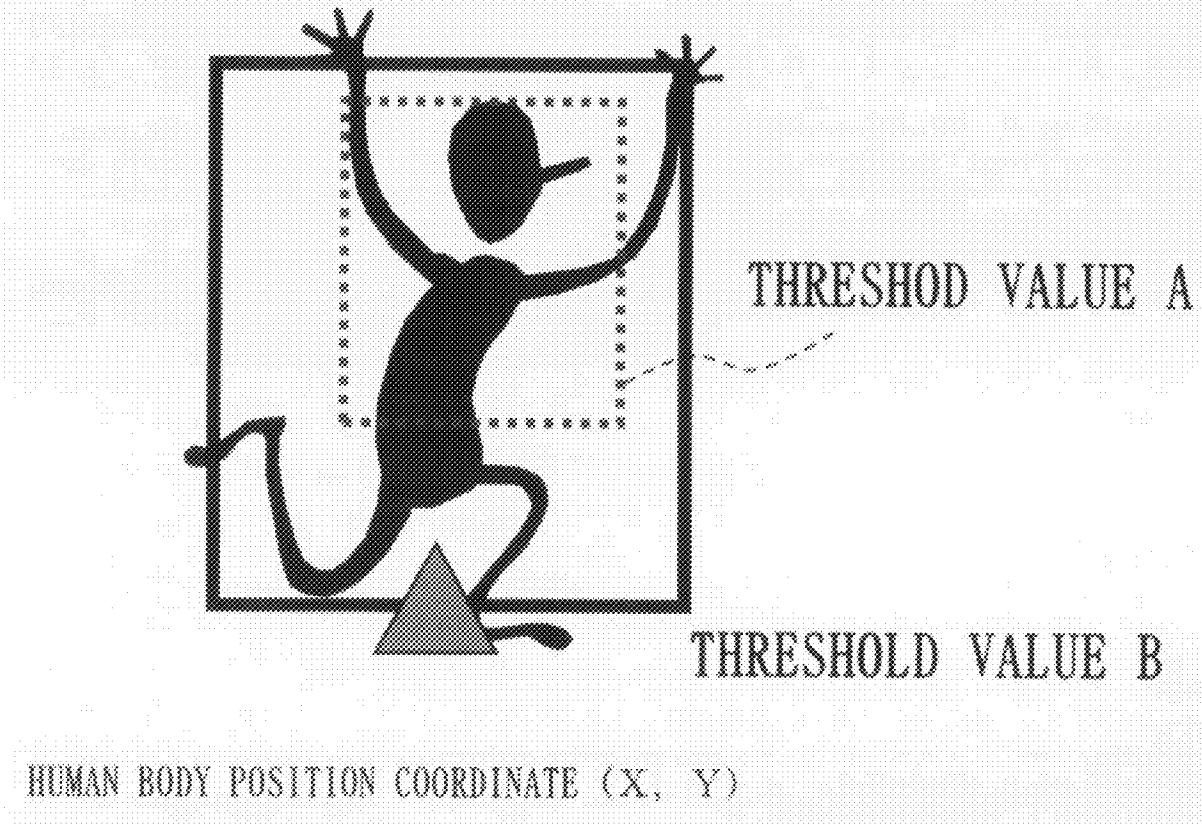
FIG. 25 illustrates a result of determining the human detection based on a threshold value A and a threshold value B, by taking a difference between an adjacent background image and a thermal image data where a human body is present, in accordance with the first embodiment.
Figure 26:
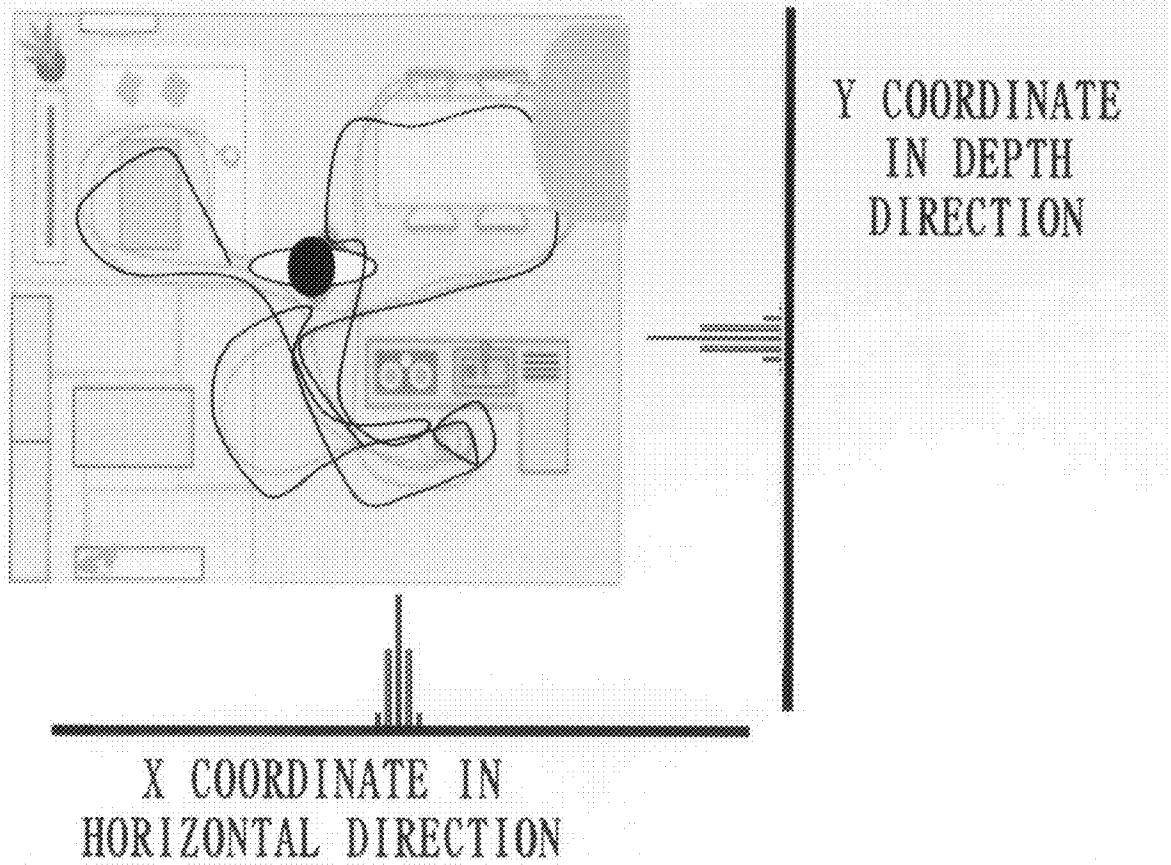
FIG. 26 shows a state of integrated count of the human body detection position worked out from the difference in the thermal image data as the human position coordinate point (X, Y) performing the coordinate transformation by the floor coordinate transforming unit 55, for each X axis and Y axis, in accordance with the first embodiment.
Figure 27:
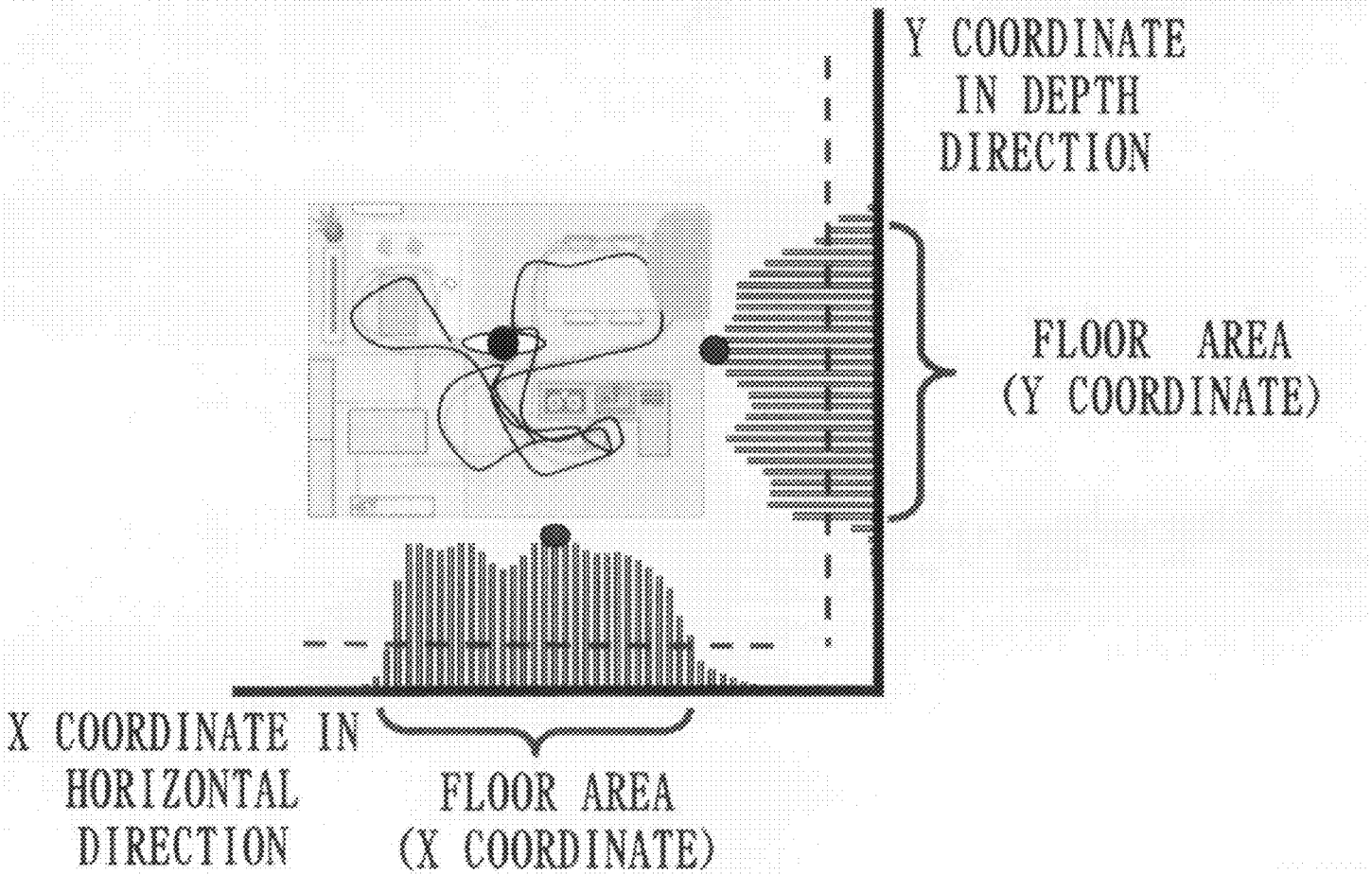
FIG. 27 illustrates a determined result of the room shape based on the human body position log, in accordance with the first embodiment.
Figure 28:
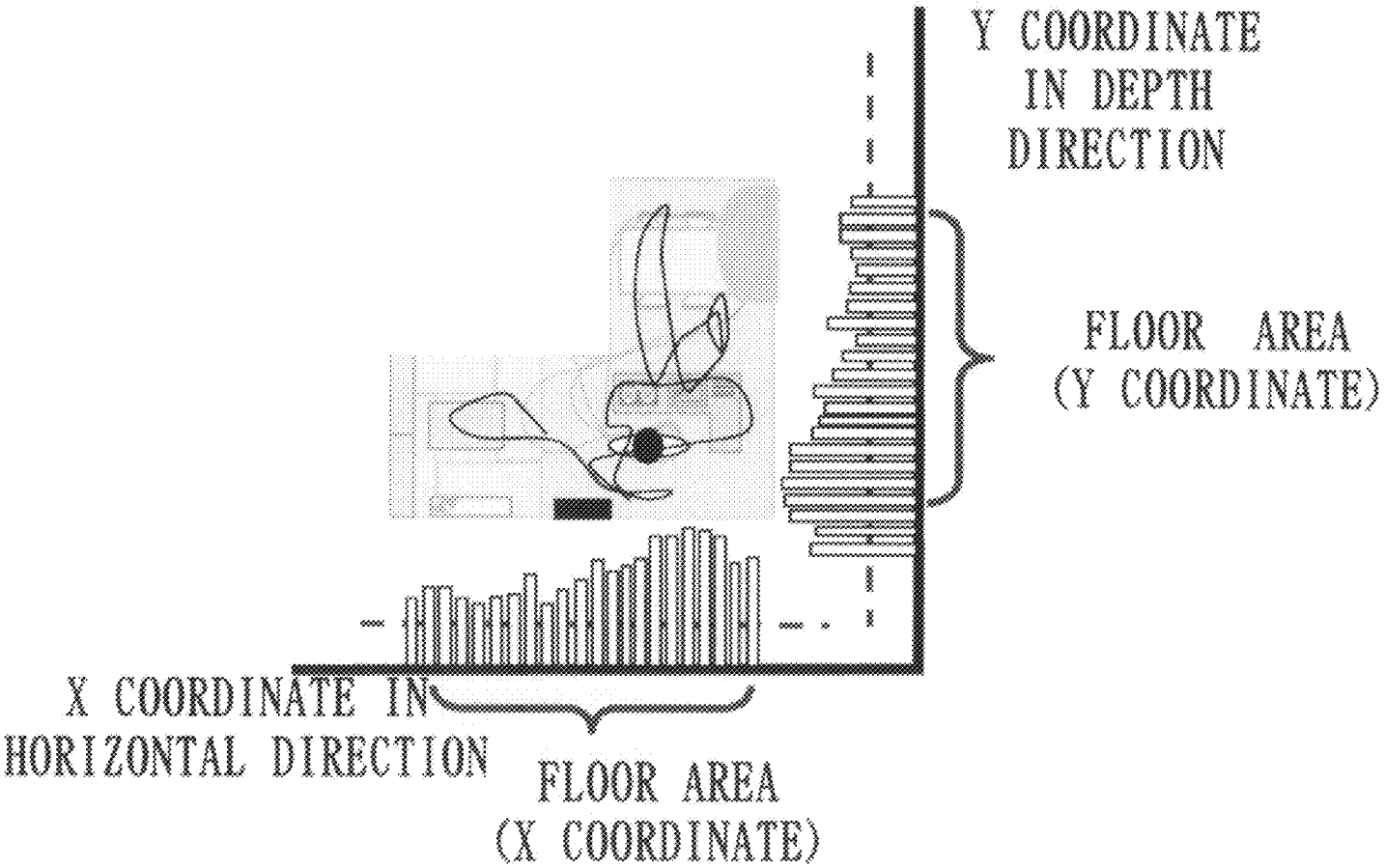
FIG. 28 illustrates a result of the human body detection position log for a L-shaped living room, in accordance with the first embodiment.
Figure 29:
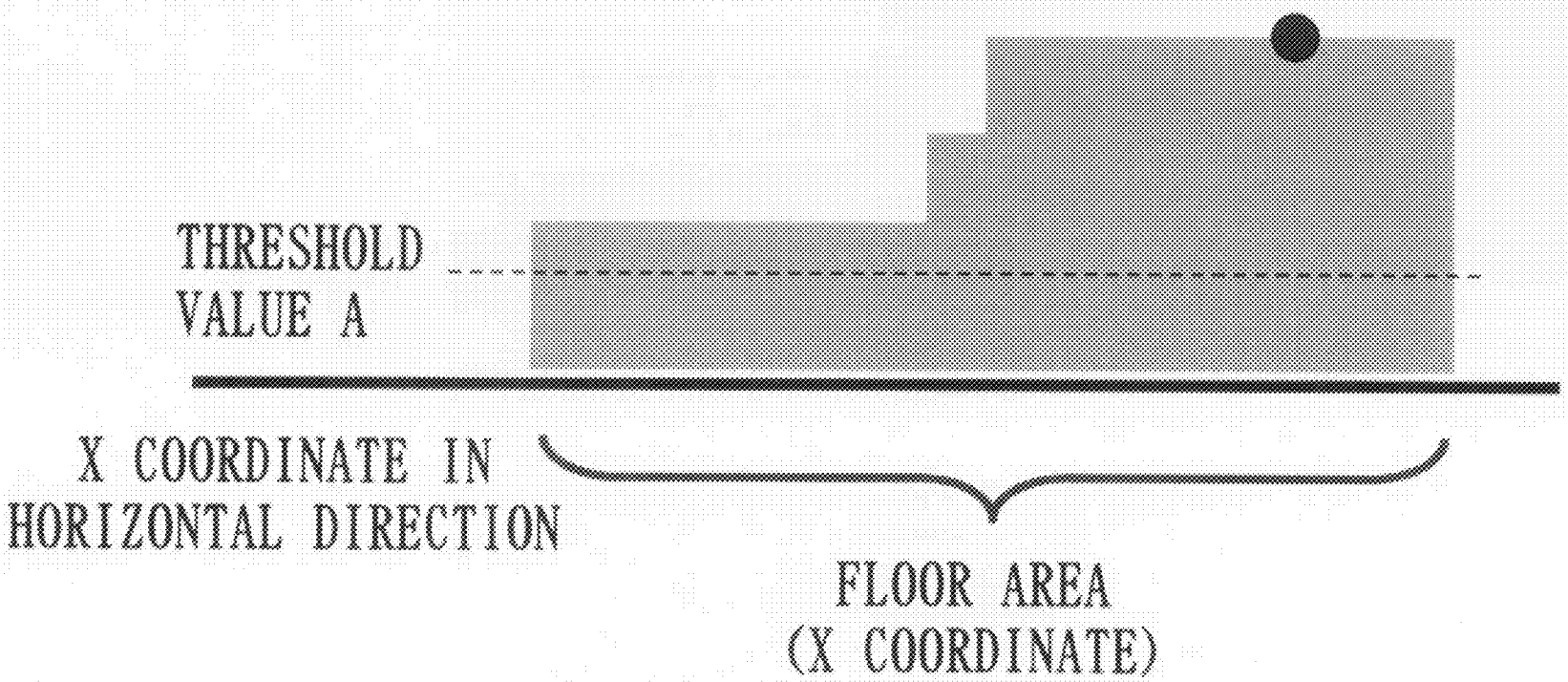
FIG. 29 illustrates a count number accumulated on the floor area (the X coordinate), in a horizontal direction X-coordinate, in accordance with the first embodiment.
Figure 30:
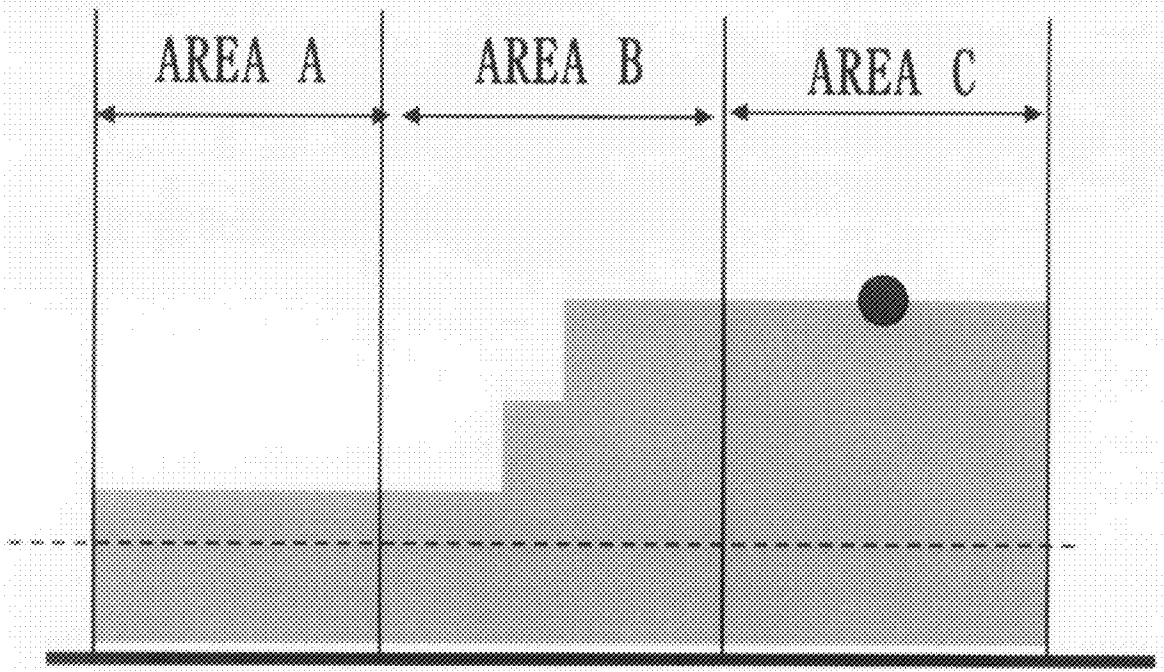
FIG. 30 is a drawing that shows a division of the floor area (the X coordinate) obtained in FIG. 29 into three equivalent areas A, B and C, finds which area a maximum accumulated value is present, and works out a maximum value and minimum value for each area at the same time.
Figure 31:
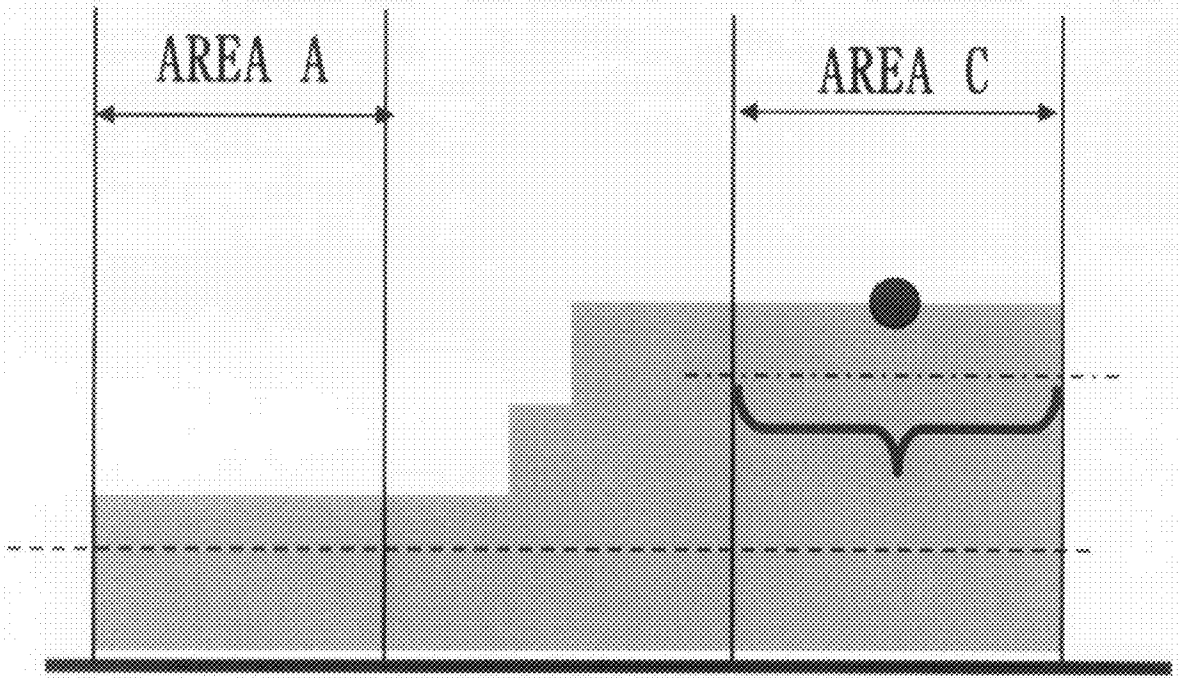
FIG. 31 illustrates a method for determining from that no less than $\gamma$ number (the number inside the area divided for every 0.3 m) of an upper 90% of the count number of the maximum accumulation number is present, when the maximum accumulation number of the accumulation data is present inside the area C, in accordance with the first embodiment.
Figure 32:
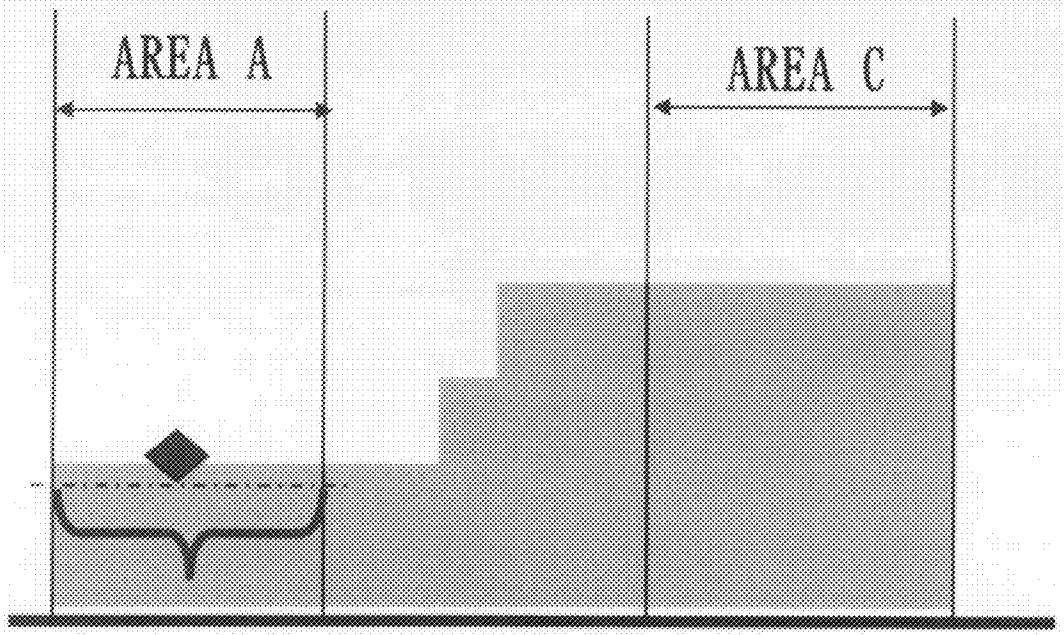
FIG. 32 illustrates a method for determining from that no less than $\gamma$ number (the number inside the area divided for every 0.3 m) of an upper 90% of the count number of the maximum accumulation number is present, when the maximum accumulation number of the accumulation data is present inside the area A, in accordance with the first embodiment.
Figure 33:
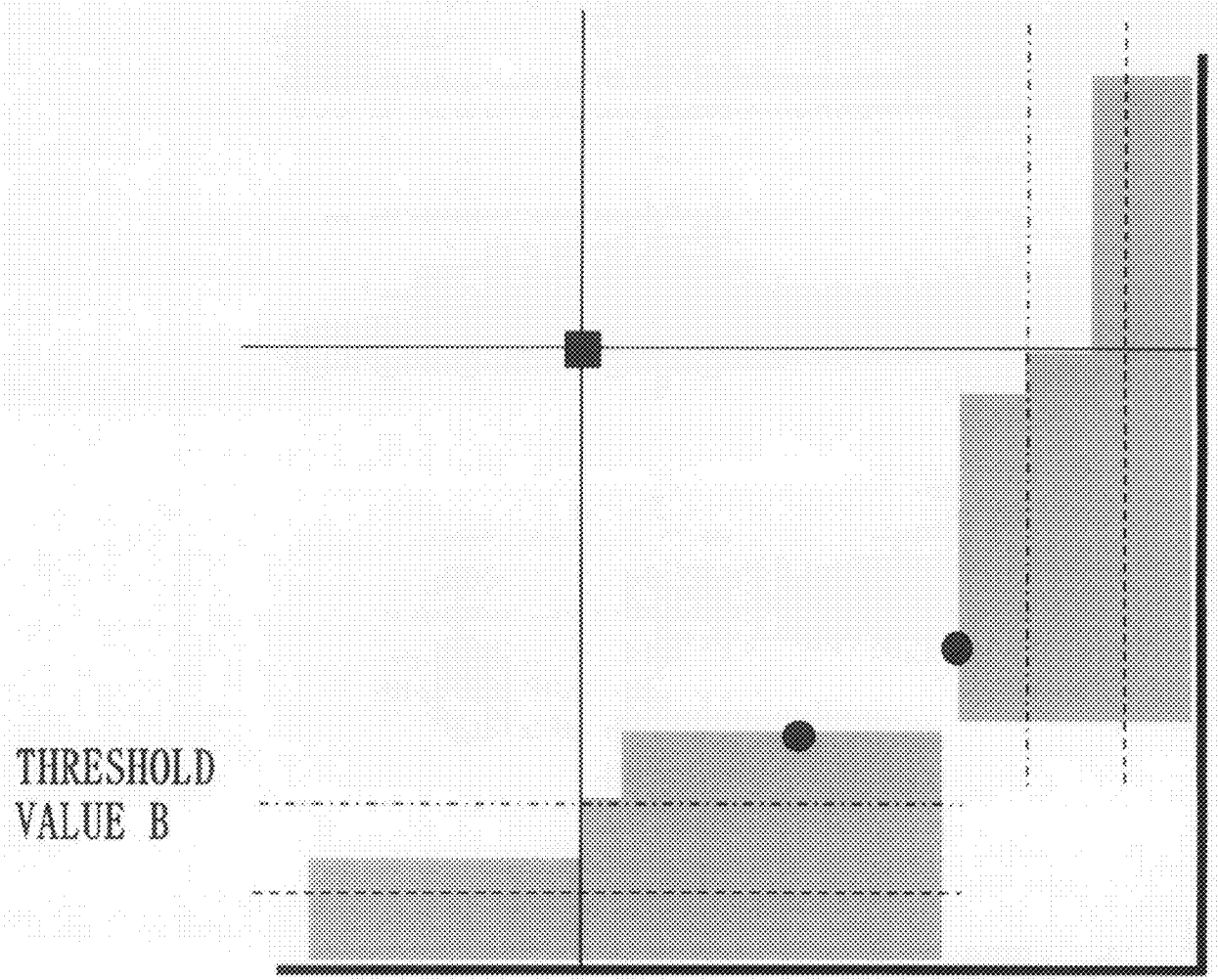
FIG. 33 is a drawing that calculates locations that are 50% or more are worked out for the maximum accumulation number, when determined as a L-shaped room, in accordance with the first embodiment.
Figure 34:
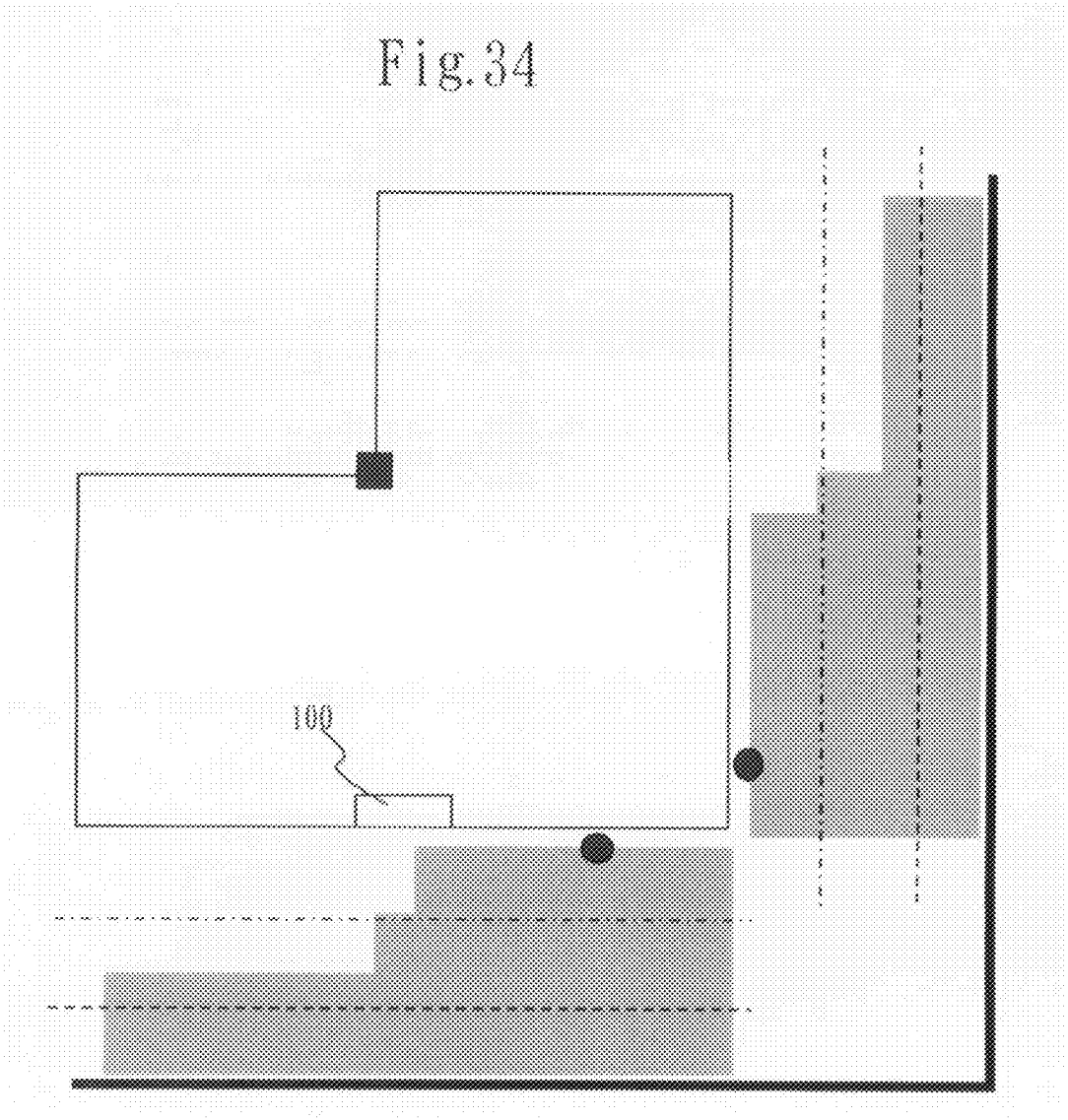
FIG. 34 illustrates a floor area shape for the L-shaped room worked out based on the boundary point between the floor and the wall of the L-shaped room calculated in FIG. 33, and the X coordinate and Y coordinate of the floor area which is not less than the threshold value A, in accordance with the first embodiment.
Figure 35:
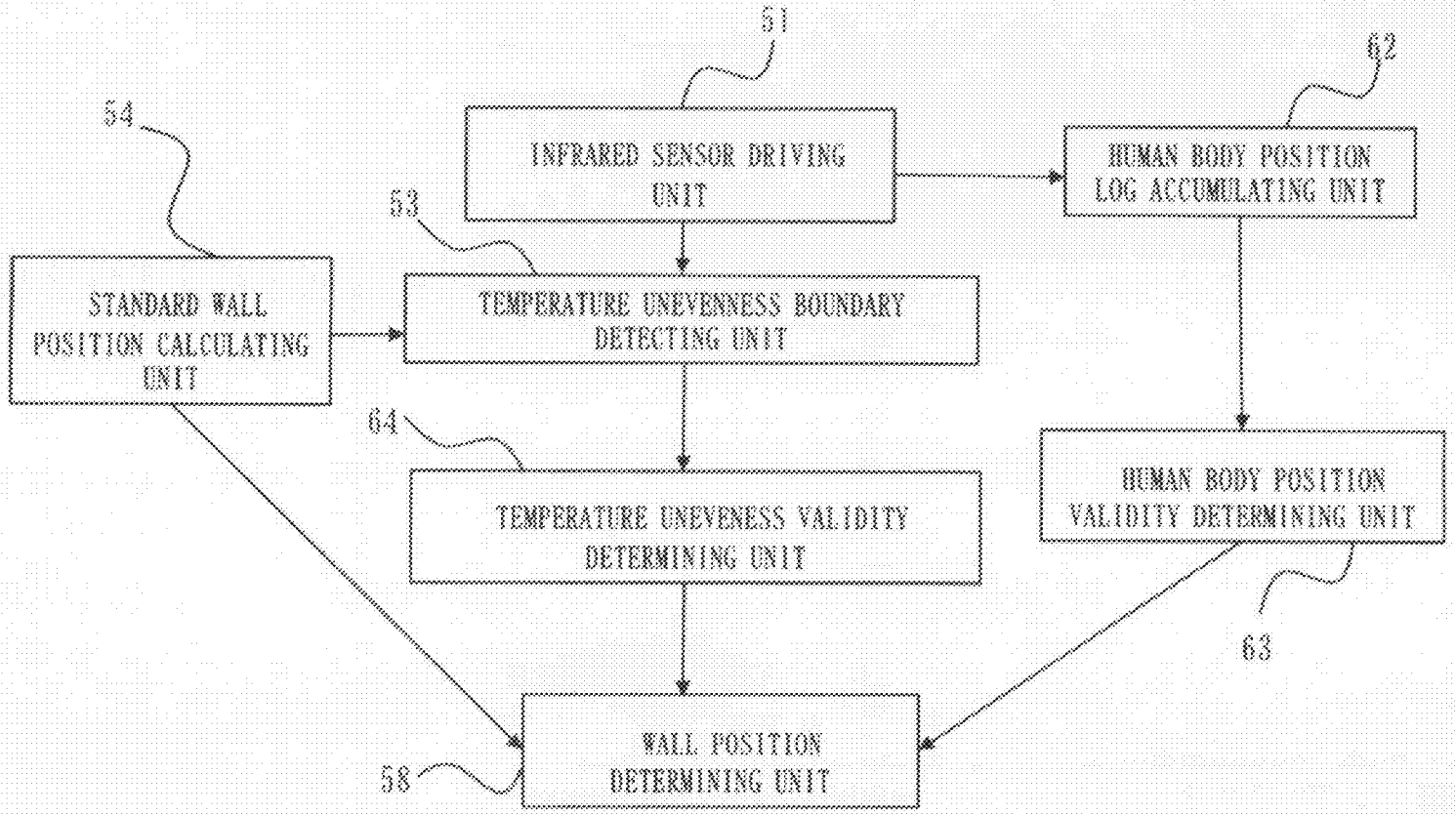
FIG. 35 is a flowchart for integrating three information, in accordance with the first embodiment.
Figure 36:
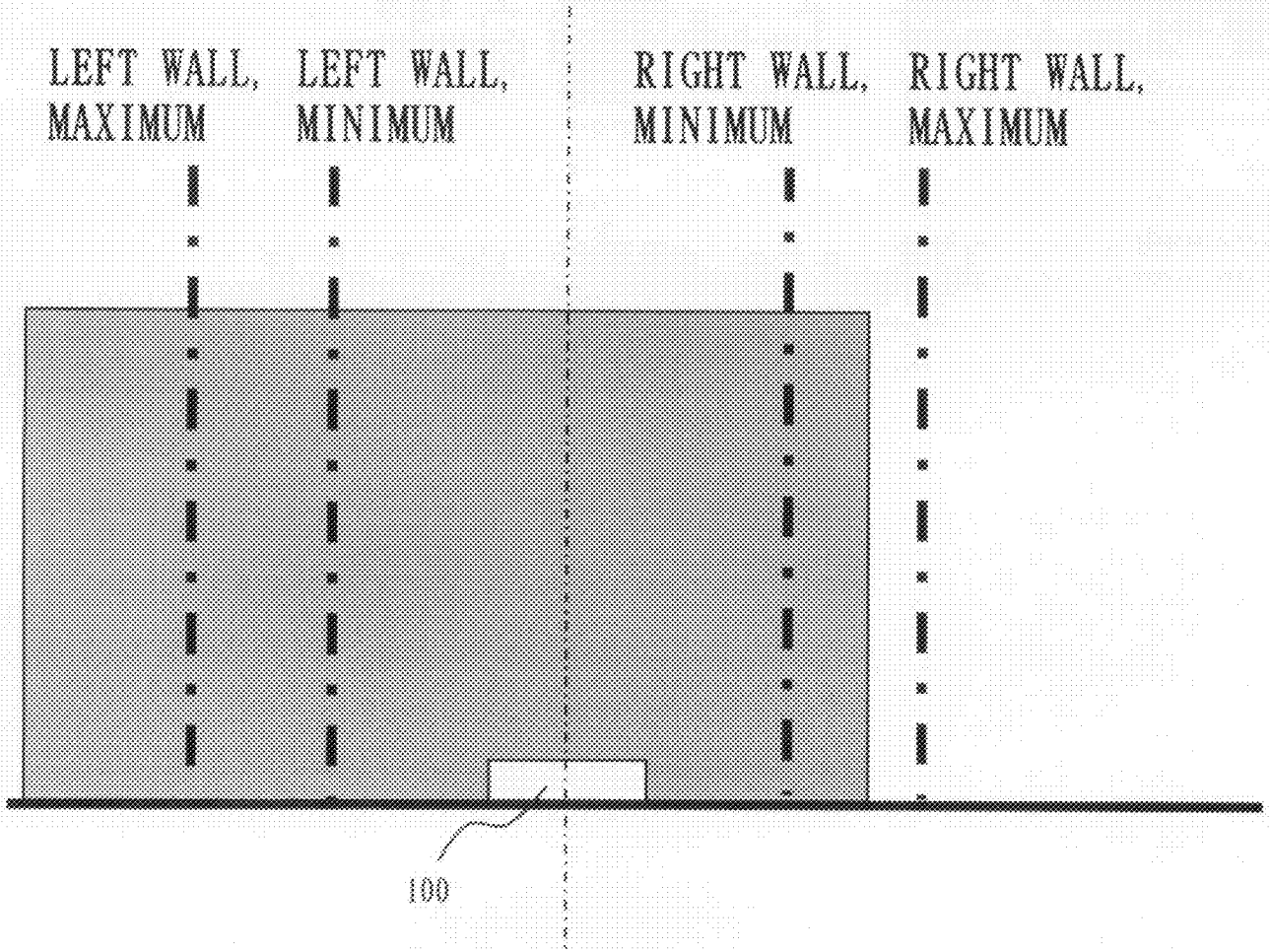
FIG. 36 illustrates a result of the room shape based on the temperature unevenness detection at a remote controller central installation position condition, with the capacity of 2.8 kw, in accordance with the first embodiment.
Figure 37:
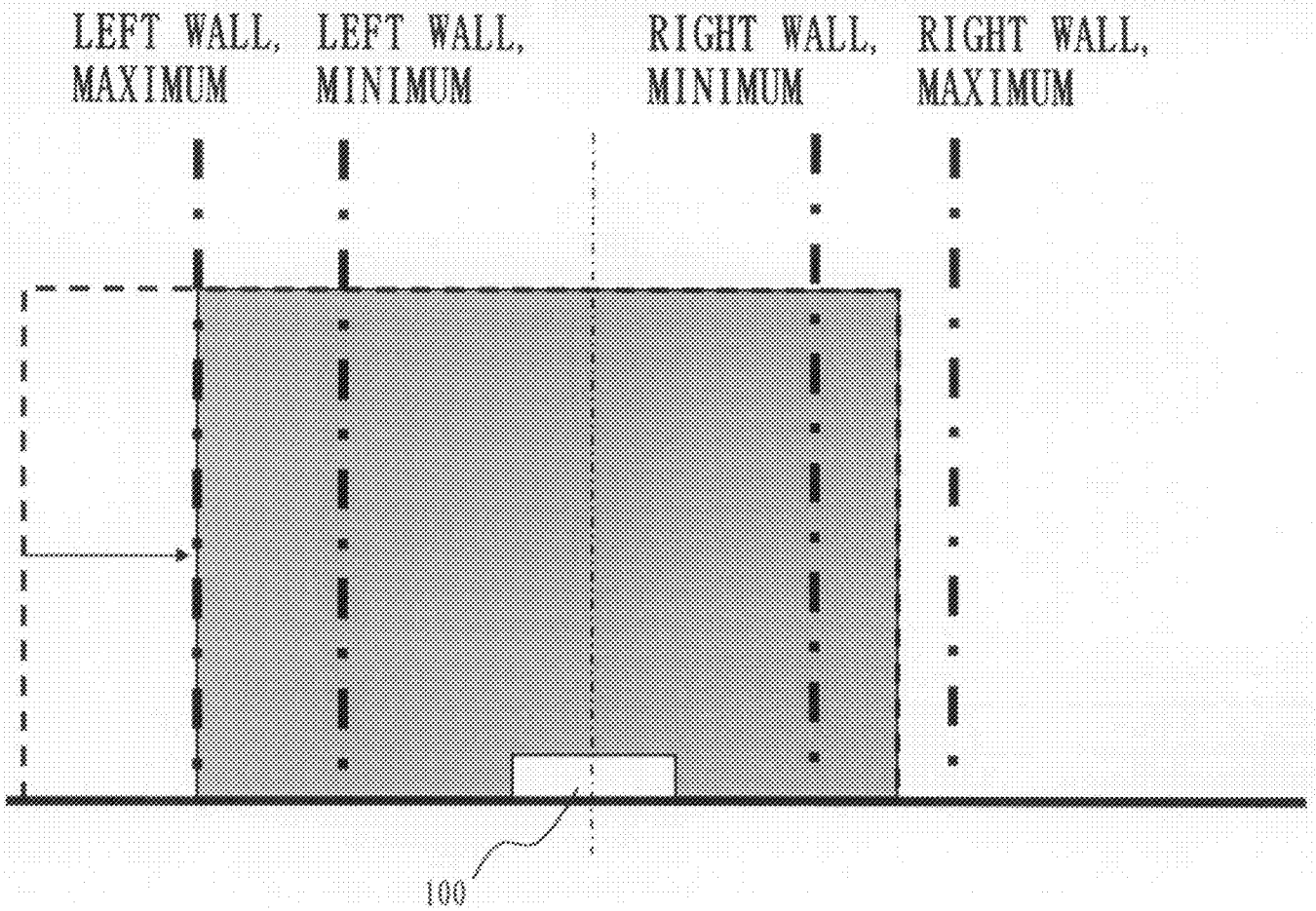
FIG. 37 illustrates a result of reducing the maximum left wall position, when a distance to the left wall 16 exceeds the distance of the maximum left wall distance, in accordance with the first embodiment.
Figure 38:
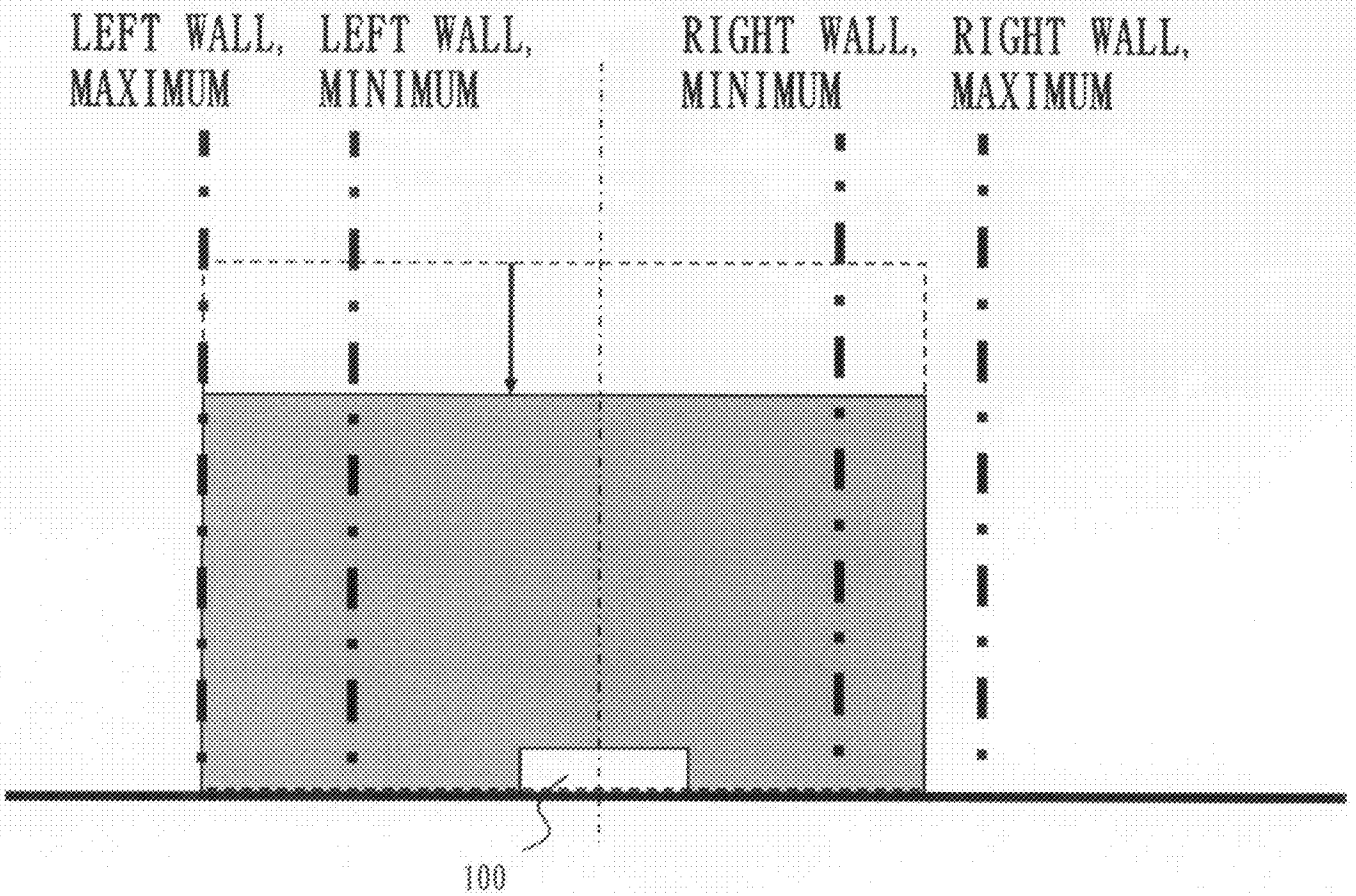
FIG. 38 illustrates an adjusted result by decreasing a distance of the frontal wall 19 down to the maximum area 19 $m^2$, when the room shape area of FIG. 37 after the correction is the maximum area value of no less than 19 $m^2$, in accordance with the first embodiment.
Figure 39:
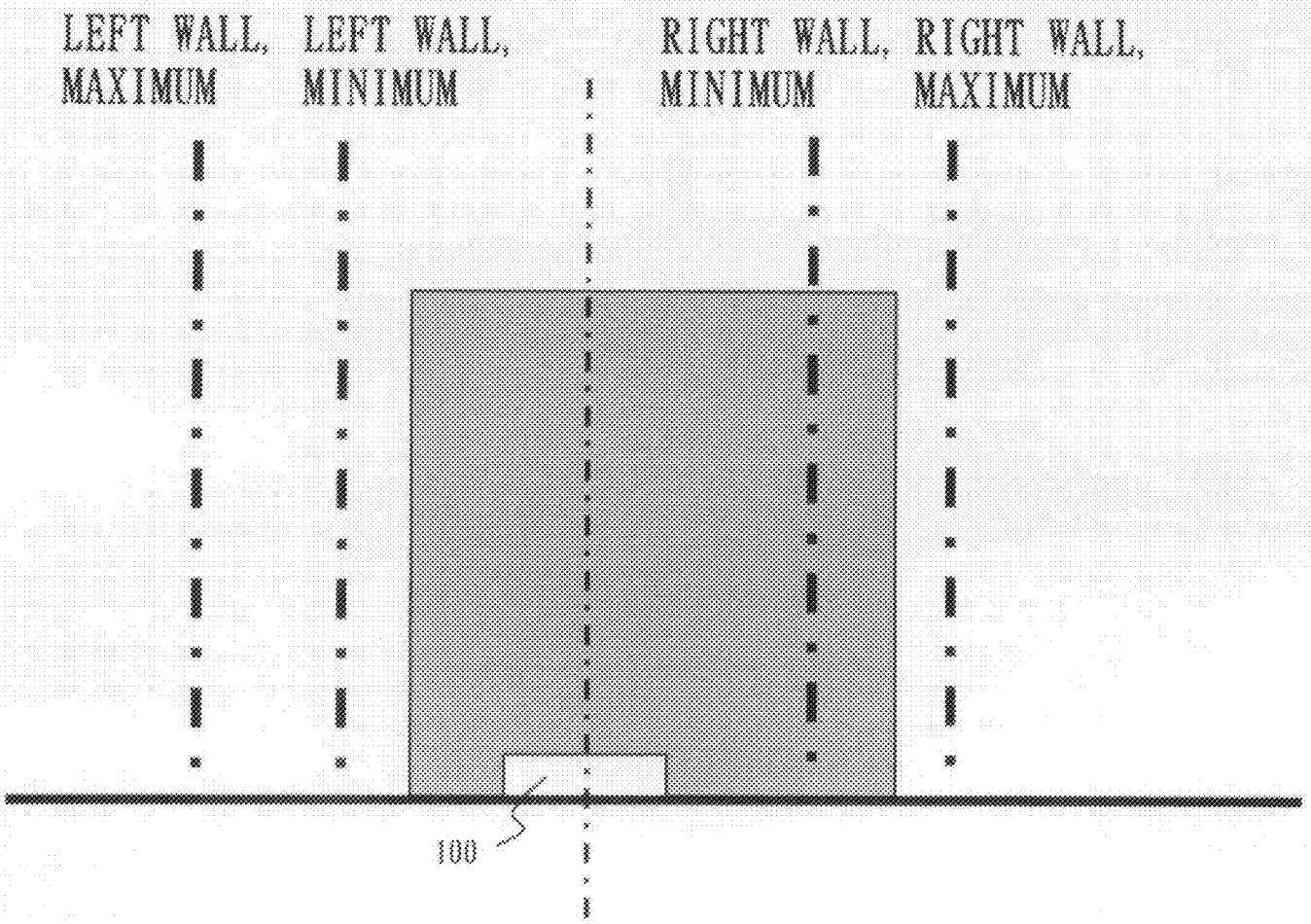
FIG. 39 illustrates an adjusted result by enlarging to the left wall minimum area when a distance to the left wall does not reach the left wall minimum, in accordance with the first embodiment.
Figure 40:
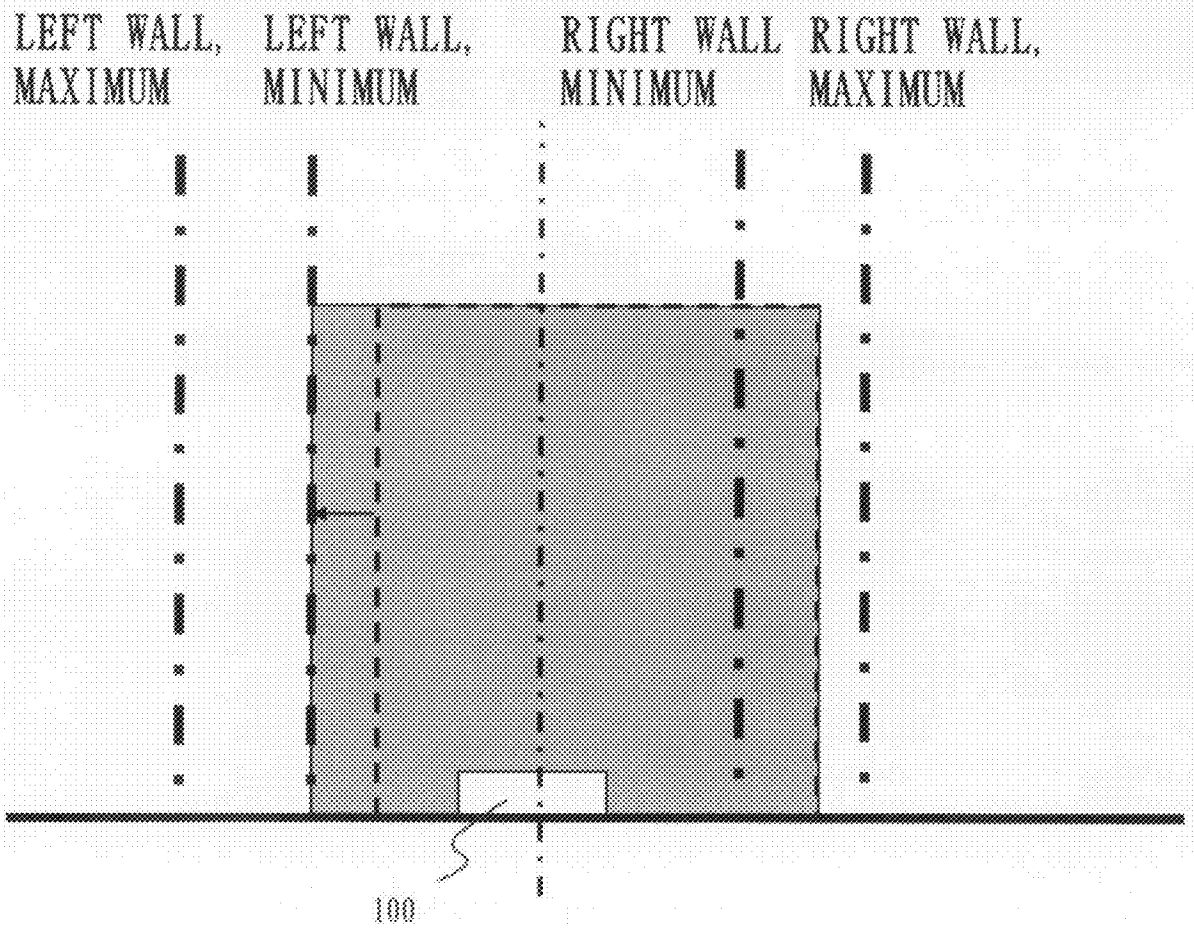
FIG. 40 illustrates an example for determining whether or not it is within the appropriate area by calculating the room shape area after the correction, in accordance with the first embodiment.
Figure 41:
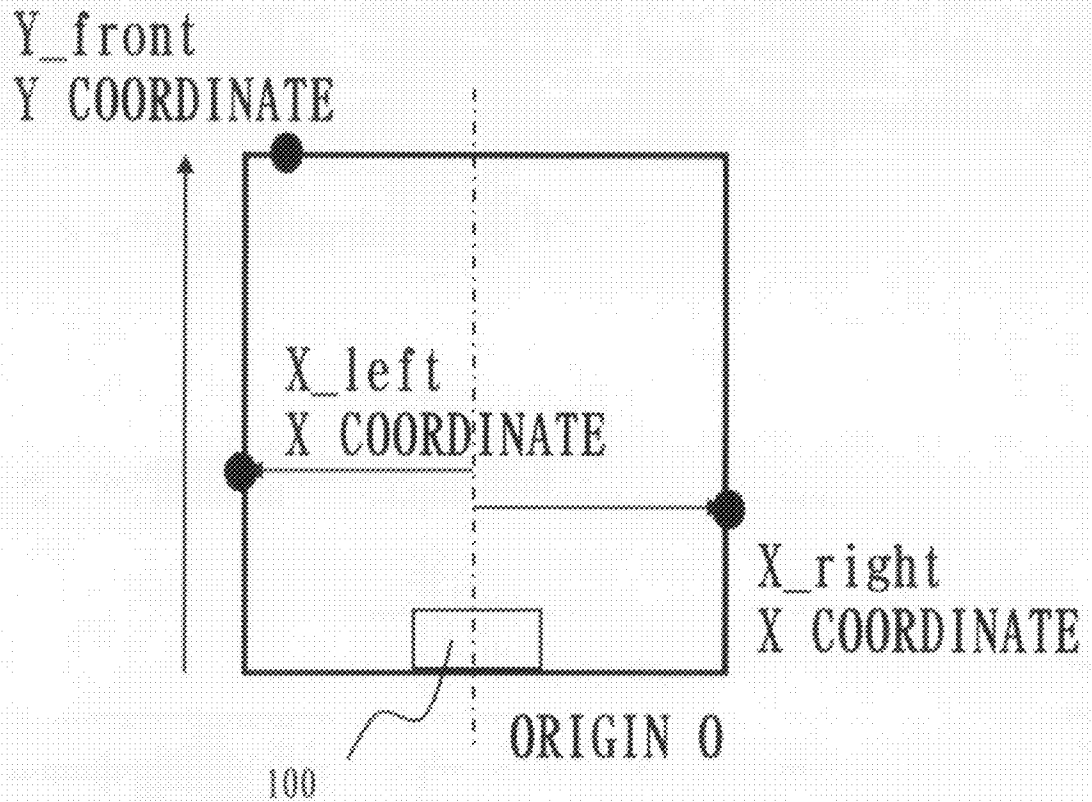
FIG. 41 is a drawing showing a result of calculating each wall distance, including a distance Y coordinate Y_front to the frontal wall 19, an X coordinate X_right of the right wall 17, and an X coordinate X_left of the left wall 16, in accordance with the first embodiment.
Figure 42:
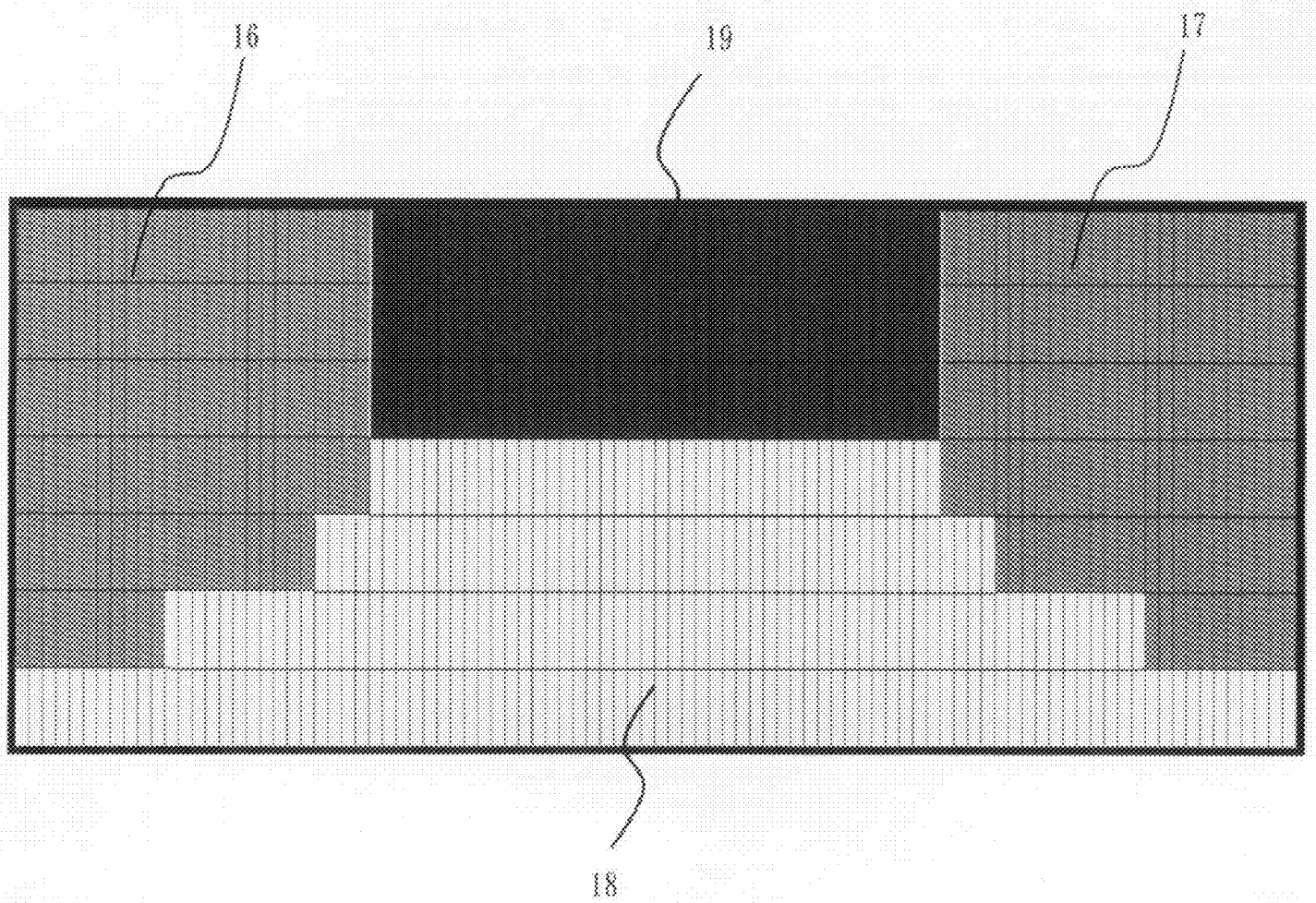
FIG. 42 is a drawing that projects in reverse each coordinate point on the floor boundary line calculated based on the respective distances between the left and right walls (the left wall 16 and the right wall 17) and the frontal wall 19 calculated under the integral conditions stated above, onto the thermal image data, in accordance with the first embodiment.
Figure 43:
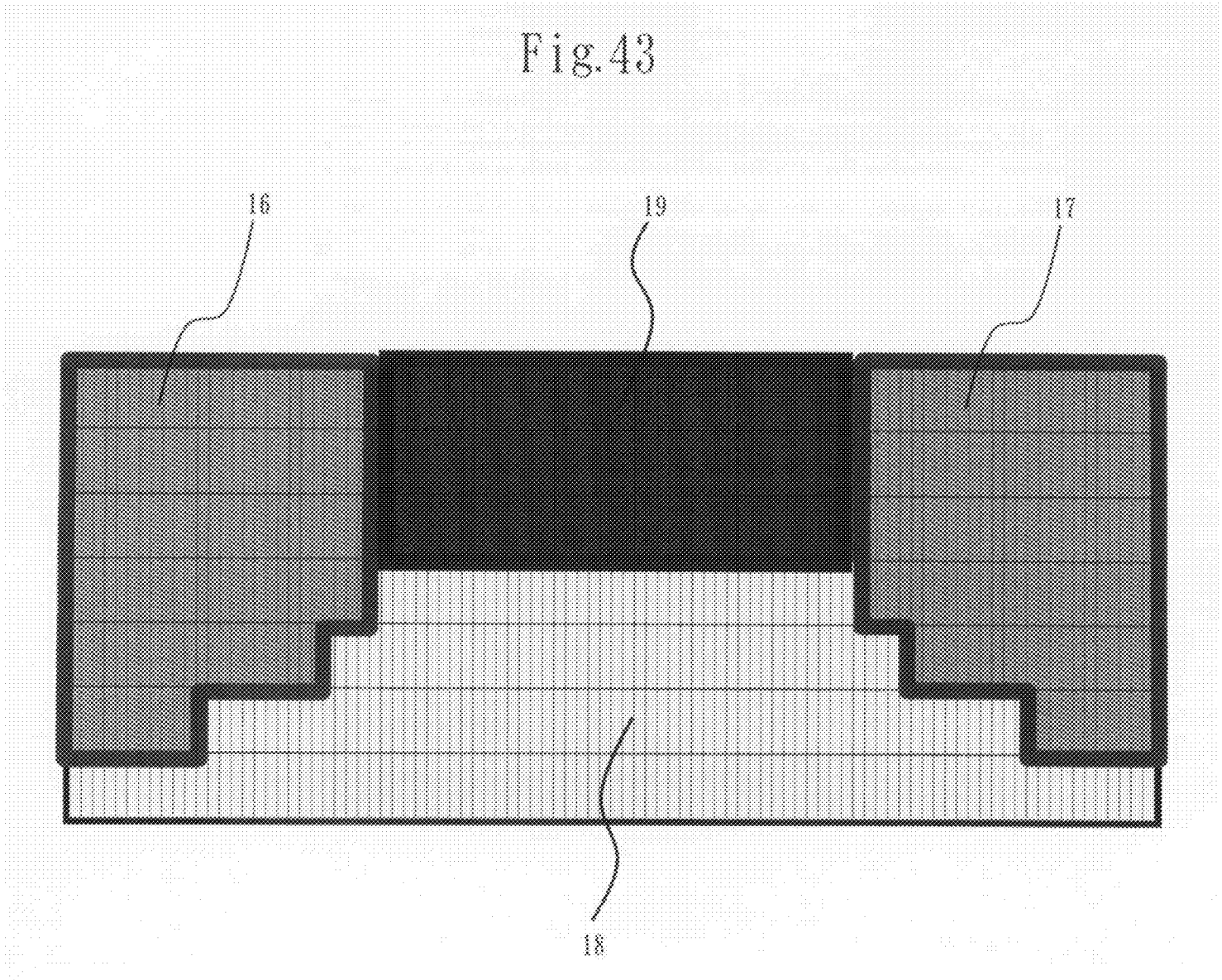
FIG. 43 is a drawing that encircles each wall area with a thick line, in accordance with the first embodiment.
Figure 44:
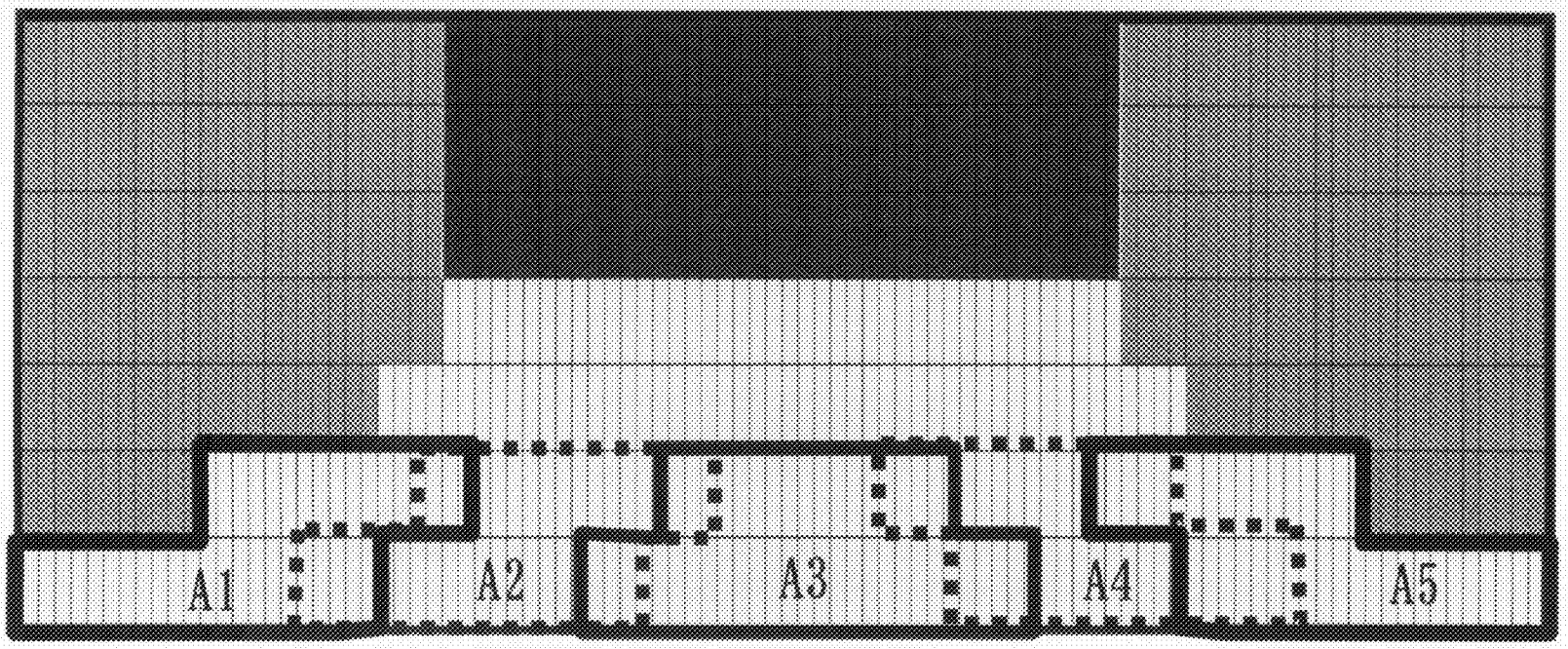
FIG. 44 is a drawing that divides into five areas (A1, A2, A3, A4 and A5) with respect to a near side area of the floor 18, in accordance with the first embodiment.
Figure 45:
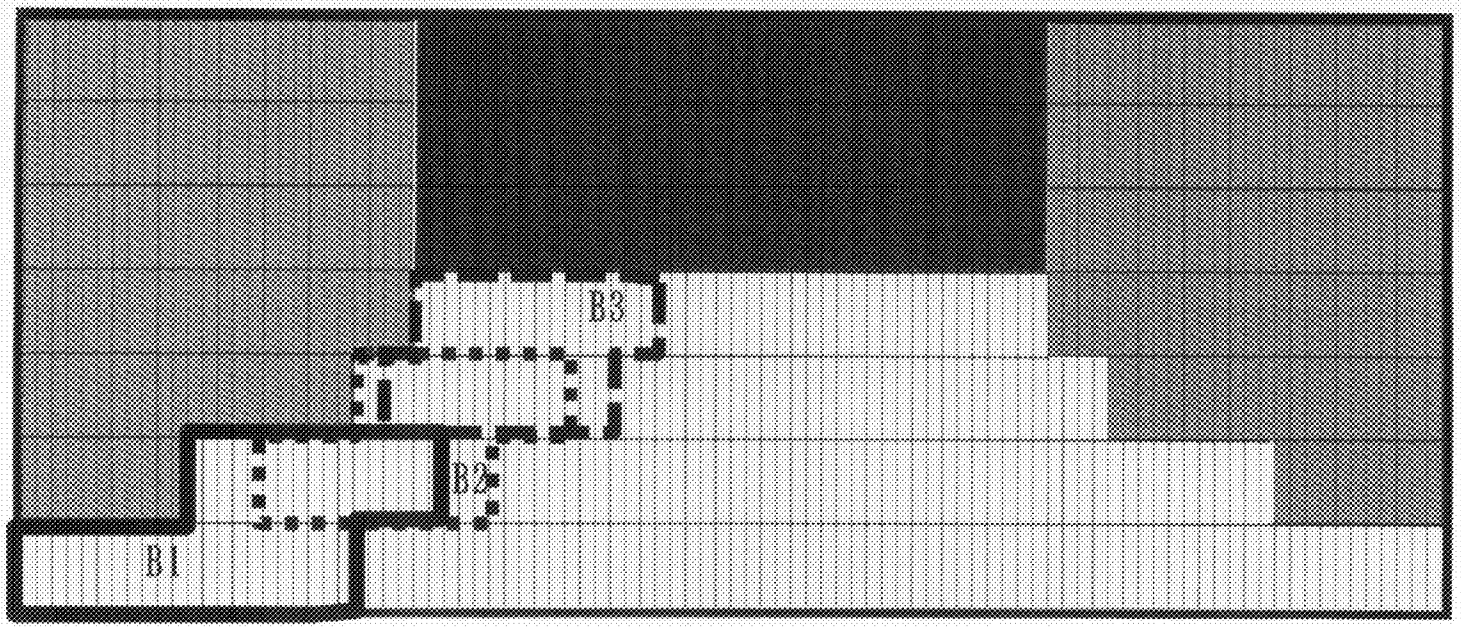
FIG. 45 is a drawing that divides into three areas (B1, B2 and B3) with respect to a far side area of the floor, in accordance with the first embodiment.
Figure 46:
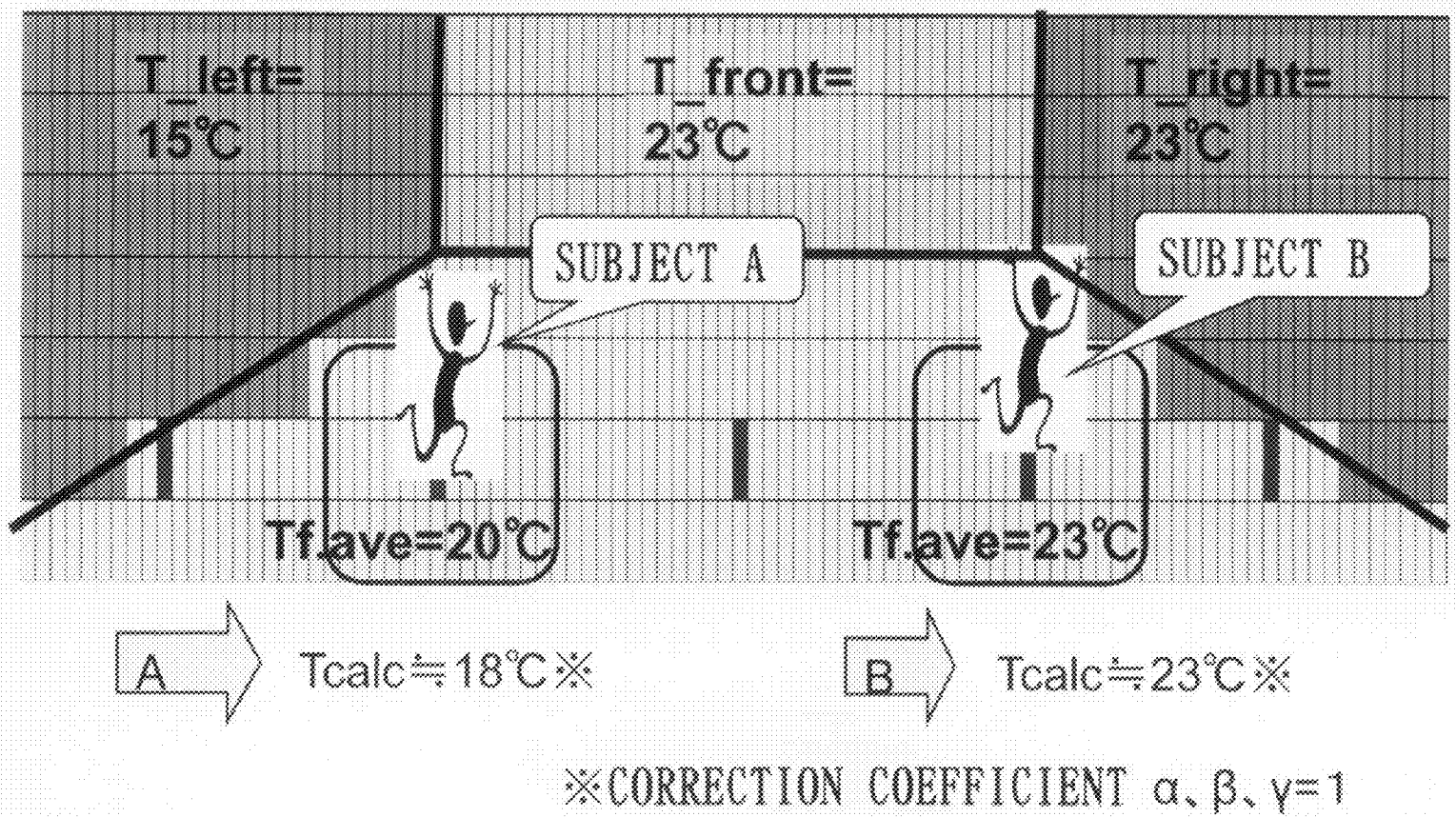
FIG. 46 illustrates an example of radiation temperature calculated by using the equation, in accordance with the first embodiment.
Figure 47:
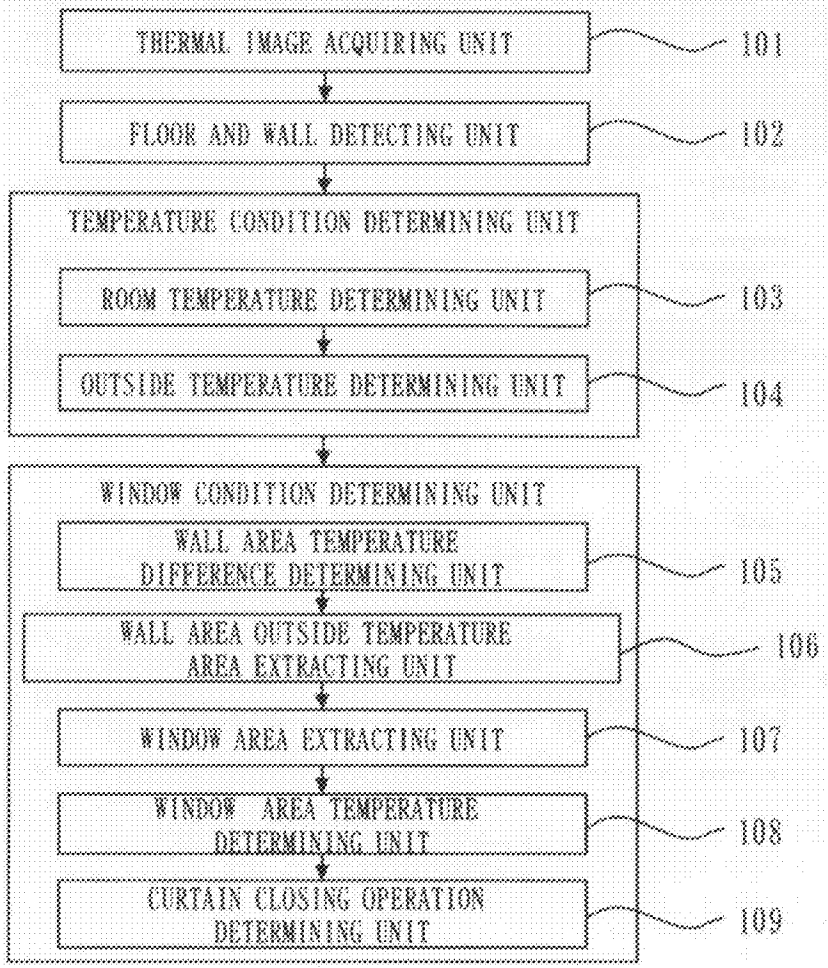
FIG. 47 is a flowchart showing an operation of detecting a curtain open and close state, in accordance with the first embodiment.
Figure 48:
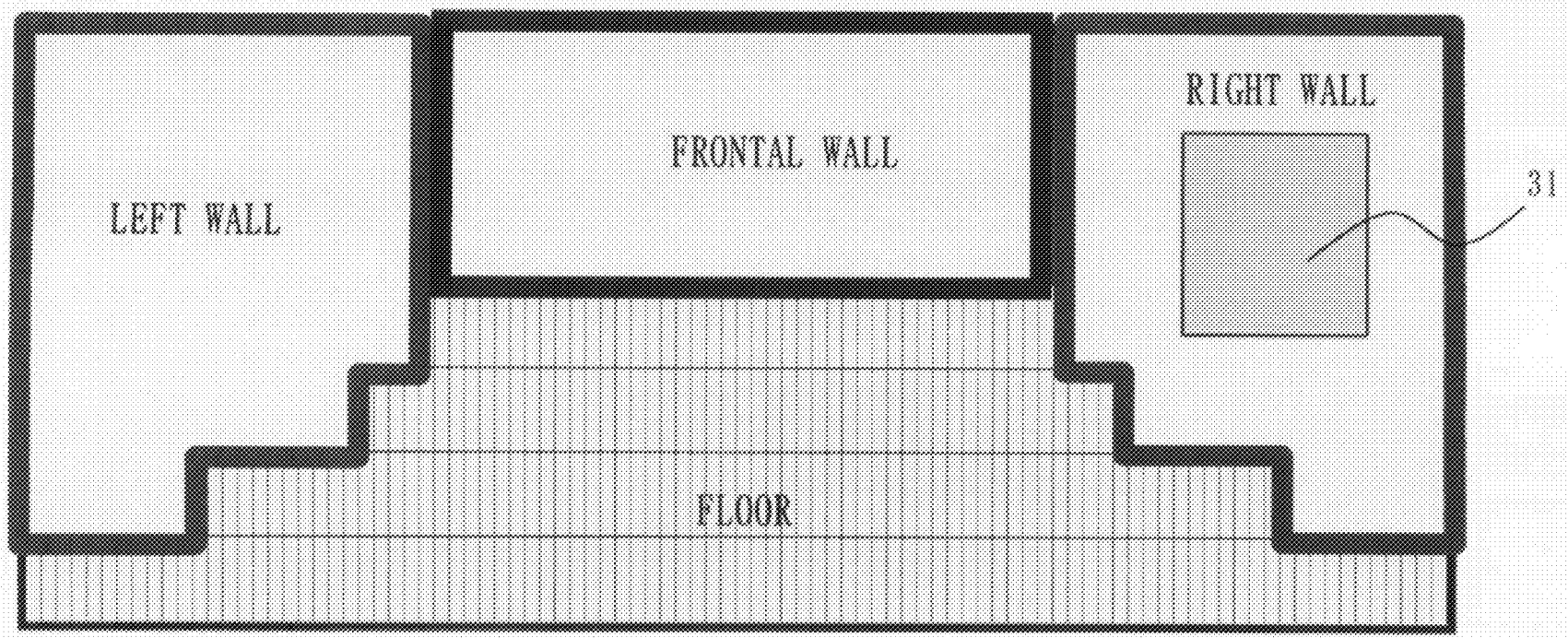
FIG. 48 illustrates a thermal data when a curtain of the left wall window is open during the heating operation, in accordance with the first embodiment.

FIGS. 1 to 48 illustrate the first embodiment. FIGS. 1 and 2 are the perspective views of the air conditioner 100. FIG. 3 is the longitudinal cross sectional view of the air conditioner 100. FIG. 4 illustrates the infrared sensor 3 and luminous intensity distribution angles of light receiving elements. FIG. 5 is the perspective view of a chassis 5 for storing the infrared sensor 3. FIG. 6 is the perspective view of a vicinity of the infrared sensor 3, which shows (a) the infrared sensor 3 moving to a right edge unit, (b) the infrared sensor 3 moving to a central part, and (c) the infrared sensor 3 moving to a left edge unit. FIG. 7 illustrates the vertical luminous intensity distribution angle in a longitudinal cross section of the infrared sensor 3. FIG. 8 illustrates the thermal image data of a room where a housewife 12 is holding a baby 1. FIG. 9 illustrates the approximate number of tatami mats and dimension (the area) during a cooling operation stipulated by a capacity zone of the air conditioner 100. FIG. 10 shows the table that specifies the dimension (area) of the floor for each capacity, by utilizing the maximum area of the dimension (area) for each capacity described in FIG. 9. FIG. 11 illustrates the length and breadth, room shape limitation values, for a capacity of 2.2 kw. FIG. 12 illustrates the lengthwise and breadthwise distance conditions, worked out from the capacity zone of the air conditioner 100. FIG. 13 illustrates the central installation condition for the capacity of 2.2 kw. FIG. 14 shows the case of installation to the left corner (viewed from the user), for the capacity of 2.2 kw. FIG. 15 illustrates the position relation between the floor and the walls on the thermal image data upon setting the remote controller installation position at the center, for the capacity of 2.2 kw of the air conditioner 100. FIG. 16 illustrates the flow for calculating the room shape based on the temperature unevenness. FIG. 17 illustrates the upper and lower pixels serving as a boundary between the wall and the floor on the thermal image data of FIG. 15. FIG. 18 is the drawing for detecting a temperature arising between the upper and lower pixels including 1 pixel in a lower direction and 2 pixels in an upper direction (3 pixels in total), in respect to the position of a boundary line 60 set at FIG. 17. FIG. 19 is the drawing showing pixels that exceeded the threshold value and pixels exceeding a maximum value of inclination detected by a temperature unevenness boundary detecting unit 53 for detecting the temperature unevenness boundary in a pixel detection area, are marked in black. FIG. 20 illustrates the result of detecting the boundary line based on the temperature unevenness. FIG. 21 illustrates the result of transforming a coordinate point (X, Y) of each element drawn at a lower part of the boundary line as a floor coordinate point by a floor coordinate transforming unit 55, on the thermal image data, and projecting onto the floor 18. FIG. 22 illustrates the area of pixel targeted for detecting the temperature difference around the position of a frontal wall 19 under the initial setting condition in the remote controller central installation condition, at the capacity of 2.2 kw. FIG. 23 is the drawing for calculating a wall position for the frontal wall 19 and the floor 18 by working out an average of the distribution element coordinate point of each element for detecting a vicinity of the floor wall 19 shown in FIG. 22, in terms of FIG. 21 that projected the boundary line element coordinate of each thermal image data on the floor 18. FIG. 24 is the flow for calculating a room shape based on the human body detection position log. FIG. 25 illustrates the result of determining the human detection based on a threshold value A and a threshold value B, by taking a difference between an adjacent background image and a thermal image data where a human body is present. FIG. 26 shows the state of integrated count of the human body detection position worked out from the difference in the thermal image data as the human position coordinate point (X, Y) performing the coordinate transformation by the floor coordinate transforming unit 55, for each X axis and Y axis. FIG. 27 illustrates the determined result of the room shape based on the human body position log. FIG. 28 illustrates the result of the human body detection position log for a L-shaped living room. FIG. 29 illustrates the count number accumulated on the floor area (the X coordinate), in a horizontal direction X-coordinate. FIG. 30 is the drawing that shows a division of the floor area (the X coordinate) obtained in FIG. 29 into three equivalent areas A, B and C, finds which area a maximum accumulated value is present, and works out a maximum value and minimum value for each area at the same time. FIG. 31 illustrates the method for determining from that no less than γ number (the number inside the area divided for every 0.3 m) of an upper 90% of the count number of the maximum accumulation number is present, when the maximum accumulation number of the accumulation data is present inside the area C. FIG. 32 illustrates the method for determining from that no less than γ number (the number inside the area divided for every 0.3 m) of an upper 90% of the count number of the maximum accumulation number is present, when the maximum accumulation number of the accumulation data is present inside the area A. FIG. 33 is the drawing that calculates locations that are 50% or more are worked out for the maximum accumulation number, when determined as a L-shaped room. FIG. 34 illustrates the floor area shape for the L-shaped room worked out based on the boundary point between the floor and the wall of the L-shaped room calculated in FIG. 33, and the X coordinate and Y coordinate of the floor area which is not less than the threshold value A. FIG. 35 is the flowchart for integrating three information. FIG. 36 illustrates the result of the room shape based on the temperature unevenness detection at a remote controller central installation position condition, with the capacity of 2.8 kw. FIG. 37 illustrates the result of reducing the maximum left wall position, when a distance to the left wall 16 exceeds the distance of the maximum left wall distance. FIG. 38 illustrates the adjusted result by decreasing a distance of the frontal wall 19 down to the maximum area 19 $m^2$, when the room shape area of FIG. 37 after the correction is the maximum area value of no less than 19 $m^2$. FIG. 39 illustrates the adjusted result by enlarging to the left wall minimum area when a distance to the left wall does not reach the left wall minimum. FIG. 40 illustrates the example for determining whether or not it is within the appropriate area by calculating the room shape area after the correction. FIG. 41 is the drawing showing a result of calculating each wall distance, including a distance Y coordinate Y_front to the frontal wall 19, an X coordinate X_right of the right wall 17, and an X coordinate X_left of the left wall 16. FIG. 42 is the drawing that projects in reverse each coordinate point on the floor boundary line calculated based on the respective distances between the left and right walls (the left wall 16 and the right wall 17) and the frontal wall 19 calculated under the integral conditions stated above, onto the thermal image data. FIG. 43 is the drawing that encircles each wall area with a thick line. FIG. 44 is the drawing that divides into five areas (A1, A2, A3, A4 and A5) with respect to a near side area of the floor 18. FIG. 45 is the drawing that divides into three areas (B1, B2 and B3) with respect to a far side area of the floor. FIG. 46 illustrates the example of radiation temperature calculated by using the equation. FIG. 47 is the flowchart showing an operation of detecting a curtain open and close state. FIG. 48 illustrates the thermal data when a curtain of the left wall window is open during the heating operation.

An entire configuration of the air conditioner 100 (the indoor unit) will be described with reference to FIGS. 1 to 3. FIGS. 1 and 2 are the external perspective views of the air conditioner 100, viewed from different angles. FIG. 1 is different from FIG. 2 in the following point. In FIG. 1, upper and lower louvers 43 are shut (two upper and lower airflow control plates, one each on the right and left). In FIG. 2, the upper and lower louvers 43 are open and inner left and right louvers 44 (the left and right airflow control plates, plural in numbers) can be seen.

As shown in FIG. 1, the air conditioner 100 (the indoor unit) forms an air suction port 41 for sucking air of the room on an upper face of an indoor unit chassis 40 having a substantially box shape (defined as "main body").

Also, an air outlet port 42 for discharging conditioned air is formed to a lower part of the front face. The air outlet port 42 provides the upper and lower louvers 43 and the right and left louvers 44, for controlling directions of discharged air. The upper and lower louvers 43 control upper and lower airflow directions of the discharging air. The left and right louvers 44 control right and left airflow directions of the discharged air.

The infrared sensor 3 is provided above the air outlet port 42, at a lower portion of the frontal face of the indoor unit chassis 40. The infrared sensor 3 is attached facing down at a depression angle of approximately 24.5 degrees.

The depression angle is an angle below a horizontal line and a central axis of the infrared sensor 3. In other words, the infrared sensor 3 is attached at a downwardly facing angle of approximately 24.5 degrees with respect to the horizontal line.

As shown in FIG. 3, the air conditioner 100 (the indoor unit) provides a fan 45 inside, and a heat exchanger 46 mounted so as to surround the fan 45.

The heat exchanger 46 is connected to a compressor and the like loaded on an outdoor unit (not illustrated) thereby forming a refrigerating cycle. The heat exchanger 46 operates as an evaporator at the cooling operation, and as a condenser at the heating operation.

The fan 45 absorbs an indoor air from the air suction port 41, the heat exchanger 46 exchanges heat with a refrigerant of the refrigerating cycle, and the air passes through the fan 45 to be discharged from the air outlet port 42 into the room.

The upper and lower airflow directions and the right and left airflow directions are controlled by the upper and lower louvers 43 and the left and right louvers 44 (not illustrated in FIG. 3). In FIG. 3, the upper and lower louvers 43 are being set to an angle of the horizontal discharge.

As illustrated in FIG. 4, the infrared sensor 3 arranges eight light receiving elements (not illustrated) inside a metallic can 1, in a row, at a vertical direction. On an upper face of the metallic can 1, a window made of lens (not illustrated) is provided to allow the infrared rays to pass through the eight light receiving elements. A luminous intensity distribution angle 2 of each light receiving element is 7 degrees in the vertical direction and 8 degrees in the horizontal direction. This example has illustrated the case in which the luminous intensity distribution angle 2 of each light receiving element of 7 degrees in the vertical direction and 8 degrees in the horizontal direction, but these are not limited to 7 degrees in the vertical direction and 8 degrees in the horizontal direction. A number of the light receiving elements may change depending on the luminous intensity distribution angle 2 of each light receiving element. For instance, a product of the vertical luminous intensity distribution angle of one light receiving element and the number of the light receiving elements may be fixed.

FIG. 5 is the perspective view of the vicinity of the infrared sensor 3, viewed from the rear side (from inside of the air conditioner 100). As shown in FIG. 5, the infrared sensor 3 is stored inside the chassis 5. The infrared sensor 3 is attached to the air conditioner 100 by fixing an attachment portion 7 which is integrated with the chassis 5 to a lower portion of the frontal face of the air conditioner 100. When the infrared sensor 3 is attached to the air conditioner 100, in this state, a stepping motor 6 and the chassis 5 are perpendicular to one another. The infrared sensor 3 is attached in a downwardly at the depression angle of approximately 24.5 degrees.

The infrared sensor 3 rotably drives within a prescribed angle range in the right and left direction by the stepping motor 6 (such a rotable driving motion is expressed as "moving"). However, the infrared sensor 3 moves from the right edge unit as shown in (a) of FIG. 6, bypassing the central portion as shown in (b) of FIG. 6, to the left edge unit as shown in (c) of FIG. 6, and when it reaches the left edge unit as shown in (c) of FIG. 6, it reverses to an opposite direction and continues moving. This operation is repeated. The infrared sensor 3 detects the temperature of the temperature detection target while scanning the temperature detection target area of the room by moving from right to left.

A method for acquiring a thermal image data of walls and floor in the room by the infrared sensor 3 will be described herein. A control of the infrared sensor 3 or the like, is executed by a microcomputer that programs a prescribed operation. The microcomputer that programs the prescribed operation is referred to as a control unit. Although the description is omitted herein, it is the control unit (the microcomputer that programs the prescribed operation) that executes the respective controls.

In order to acquire the thermal image data of the walls and floor in the room, the stepping motor 6 moves the infrared sensor 3 in the right and left direction. The infrared sensor 3 is stopped for a prescribed time (0.1 to 0.2 seconds) at each position for every 1.6 degrees (a rotably driving angle of the infrared sensor 3) of a moving angle of the stepping motor 6.

When the infrared sensor 3 stops, it waits for the prescribed time (a time shorter than 0.1 to 0.2 seconds), and obtains a detected result (the thermal image data) of the eight light receiving elements of the infrared sensor 3.

After stopping, it obtains a detected result of the infrared sensor 3. The stepping motor 6 is driven again and then stopped in order to obtain a detected result (the thermal image data). This operation is repeated for the eight light receiving elements of the infrared sensor 3.

The above operation is repeated, and the thermal image data inside of detection area is calculated based on the detected results of the infrared sensor 3 for 94 locations in the right and left direction.

Since the thermal image data is obtained by stopping the infrared sensor 3 at 94 localities in every 1.6 degrees of the moving angle of the stepping motor 6, therefore, a moving area of the infrared sensor 3 in the right and left direction (an angle range for the rotable driving motion in the right and left direction) is approximately 150.4 degrees.

FIG. 7 illustrates the vertical luminous intensity distribution angle in the longitudinal section of the infrared sensor 3, where the eight light receiving elements are arranged vertically in a row, for the air conditioner 100 which is installed at a height 1800 mm above a floor of the room.

An angle of 7 degrees shown in FIG. 7 is the vertical luminous intensity distribution angle of one light receiving element.

An angle of 37.5 degrees shown in FIG. 7 is an angle from the wall where the air conditioner 100 is installed, for an area not within a vertically viewable area of the infrared sensor 3. When the depression angle of the infrared sensor 3 is 0°, this angle is 90°−4 (the number of light receiving elements below the horizontal line)×7° (the luminous intensity distribution angle of one light receiving element)=62°. The infrared sensor 3 of the present embodiment has the depression angle of 24.5°, so that this angle will be 62°−24.5°=37.5°.

FIG. 8 illustrates a calculated result of the thermal image data, based on the detected results obtained, by moving the infrared sensor 3 in the right and left direction, for a scene from an everyday life where a housewife 12 is holding a baby 13 in a Japanese-style room with 8 tatami mats.

FIG. 8 illustrates the thermal image data acquired on a cloudy day in a winter season. Accordingly, a temperature of a window 14 is low of 10 to 15° C. Temperatures of the housewife 12 and the baby 13 are most high. An upper half of the housewife 12 and the baby 13 is especially high of 26 to 30° C. Accordingly, the temperature information of each portion of the room can be acquired, for example, by moving the infrared sensor 3 in the right and left direction.

Next, we shall describe about a room shape detecting means (the spatial recognition and detection) that decides a room shape by integrally determining based on a capacity zone of the air conditioner, a temperature difference (the temperature unevenness) in the floor and walls occurring during the air conditioning operation, and a human body detection position log.

Based on the thermal image data acquired by the infrared sensor 3, a floor area of the air conditioning area is calculated, and wall positions inside the air conditioning area on the thermal image is calculated.

Areas of the floor and walls (the walls include a frontal wall and the right and left walls, viewed from the air conditioner 100) on the thermal image are recognized, therefore, it becomes possible to calculate an average temperature of the individual wall, and it becomes possible to calculate a sensible temperature with accuracy by considering the wall temperature with respect to the human body detected on the thermal image.

Means for calculating the floor dimension on the thermal image data allows detections of the floor dimension and the room shape with accuracy by integrating three information shown below.

(1) a room shape having a shape limitation value and an initial setting value, which is calculated based on a capacity zone of the air conditioner 100 and a remote controller installation position button setting.

(2) a room shape calculated by the temperature unevenness of the floor and walls occurring during operation of the air conditioner 100.

(3) a room shape calculated by a human body detection position log.

The air conditioner 100 is classified according to the capacity zone that are standardized according to the dimension of the room for air conditioning. FIG. 9 illustrates the dimension (area) and the Japanese-style room of a fixed number of tatami mats during the cooling operation which is specified according to the capacity zone of the air conditioner 100. For example, the capacity of the air conditioner 100 of 2.2 kw for air conditioning the Japanese-style room is approximately 6 to 9 tatami mats during the cooling operation. A dimension (area) of 6 to 9 tatami mats is approximately 10 to 15 $m^2$.

FIG. 10 shows the table that specifies the dimension (area) of the floor for each capacity, by utilizing the maximum area of the dimension (area) for each capacity described in FIG. 9. When the capacity is 2.2 kw, the maximum dimension (area) of FIG. 9 is 15 $m^2$. When an aspect ratio is set to 1:1 by calculating a square root of the maximum area 15 $m^2$, a lengthwise distance and a breadthwise distance is 3.9 meters each. Maximum lengthwise and breadthwise distances and minimum lengthwise and breadthwise distances are set, provided that the maximum area of 15 $m^2$ is fixed and when the lengthwise and breadthwise distances have been varied at the aspect ratio within a range of 1:2 to 2:1.

FIG. 11 illustrates the length and breadth, the room shape limitation values, for the capacity of 2.2 kw. When the aspect ratio is set to 1:1 by calculating a square root of the maximum area 15 $m^2$ for each capacity, the lengthwise distance and the breadthwise distance is 3.9 meters each. The maximum lengthwise and breadthwise distances are set, provided that the maximum area of 15 $m^2$ is fixed and when the lengthwise and breadthwise distances have been varied at the aspect ratio within a range of 1:2 to 2:1. When the aspect ratio is 1:2, length 2.7 m:breadth 5.5 m. Likewise, when the aspect ratio 2:1, length 5.5 m:breadth 2.7 m.

FIG. 12 illustrates the lengthwise distance and the breadthwise distance conditions which are calculated based on the capacity zone of the air conditioner 100. Values of the initial values of FIG. 12 are worked out from a square root of an intermediate area for the area corresponding to each capacity. For example, an adaptable area of the capacity of 2.2 kw is 10~15 $m^2$, and the intermediate area is 12 $m^2$. The initial value of 3.5 m is calculated by the square root of 12 $m^2$. Hereinbelow, the initial values of the lengthwise distance and breadthwise distance for each capacity zone are calculated based on the similar way of thinking. At the same time, the minimum value (m) and the maximum value (m) are as calculated in FIG. 10.

Accordingly, the initial value of the room shape worked out for each capacity of the air conditioner 100 is regarded as the initial value (m) of FIG. 12 as in the lengthwise and breadthwise distances. However, an origin of the setting position of the air conditioner 100 is variable based on the remote controller installation position condition.

FIG. 13 illustrates the central installation condition, for the capacity of 2.2 kw. As FIG. 13 illustrates, a mid-point of the breadthwise distance, the initial value, is taken as an origin of the air conditioner 100. As for a position relation, the origin of the air conditioner 100 is the central part of the room having the lengthwise and breadthwise distances of 3.5 m (that is, the origin is located 1.8 m from the side).

FIG. 14 shows the case of installation to the left corner (viewed from the user), for the capacity of 2.2 kw. For the corner installation, a closer one of the distance to the right or left side wall is set to 0.6 m from the origin of the air conditioner 100 (the center point of the breadth).

In accordance to the condition "(1) a room shape having the initial setting value and the shape limitation value, which is calculated based on the capacity zone of the air conditioner 100 and the remote controller installation position button setting", a boundary line of the floor and the wall can be worked out on the thermal image data acquired from the infrared sensor 3, by determining the installation position of the air conditioner 100 with the remote controller installation position condition, on the floor dimension set based on the capacity zone of the air conditioner 100 based on the above-mentioned condition.

FIG. 15 illustrates the position relation between the floor and the walls on the thermal image data upon setting the remote controller installation position at the center, for the capacity of 2.2 kw of the air conditioner 100. Viewing from the infrared sensor 3, from a look of the situation, a left wall 16, a frontal wall 19, a right wall 17, and a floor 18 are shown on the thermal image data. The floor shape dimension at the initial setting for the capacity of 2.2 kw is as shown in FIG. 13. Hereinbelow, the left wall 16, the frontal wall 19, and the right wall 17 are called "the walls" altogether.

Next, the calculation method of "(2) a room shape calculated based on the temperature unevenness of the floor and walls occurring during the operation of the air conditioner 100" will be described. FIG. 16 shows a flow for calculating the room shape based on the temperature unevenness. The calculation method is characterized in that a thermal image data of vertical 8×horizontal 94 generated as a thermal image data by an infrared image acquiring unit 52, based on the output of an infrared sensor driving unit 51 that drives the infrared sensor 3, and a standard wall position calculating unit 54 restricts a range of performing the temperature unevenness detection on the thermal image data.

Hereinbelow, a function of the standard wall position calculating unit 54 for the remote controller central installation condition, in the air conditioner having the capacity of 2.2 kw in FIG. 15 is described.

FIG. 17 illustrates the boundary line 60 of the upper and lower pixels serving as a boundary between the wall (the left wall 16, the frontal wall 19, and the right wall 17) and the floor 18 on the thermal image data of FIG. 15. Those pixels above the boundary line 60 becomes an intensity distribution of the pixels that detects a wall temperature. Those pixels below the boundary line 60 becomes an intensity distribution of the pixels that detects a floor temperature.

Then, in FIG. 18, it is characterized in detecting temperature arising in the upper and lower pixels, including the two pixels in the upper direction and one pixel in the lower direction (a total of three pixels), in respect to the position of the boundary line 60 set at FIG. 17.

It is characterized in detecting the temperature arising on the boundary line 60 between the wall and the floor by detecting a temperature difference centering the boundary line 60 between the wall and the floor, rather than searching the temperature differences in between all the pixels of the thermal image data.

It is characterized in owing a reduction of excessive software calculation process that may result from a whole image detection (shortening the time of calculation process and reducing load) as well as an error detection process (the noise debounce process).

Next, a temperature unevenness boundary detecting unit 53 for detecting the boundary based on the temperature unevenness, in the above-mentioned area between the pixels, is characterized in detecting the boundary line 60 based on any one of the following methods, namely: (a) a determination method based on an absolute value obtained from the thermal image data of the floor temperature and the wall temperature, (b) a determination method based on a maximum value of inclination (primary differential) in a depth direction of the temperature difference for the upper and lower pixels within the detection area, and (c) a determination method based on a maximum value of inclination of the inclination (secondary differential) in the depth direction of the temperature difference for the upper and lower pixels within the detection area.

In FIG. 19, the pixels exceeding a threshold value or the pixels exceeding the maximum value of the inclination, within the pixel detection area detected by the temperature unevenness boundary detecting unit 53 for detecting the temperature unevenness boundary are marked in black. Moreover, FIG. 19 is characterized in that the positions not exceeding the threshold value for detecting the temperature unevenness boundary or the maximum value are not marked.

FIG. 20 illustrates the result of detecting the boundary line based on the temperature unevenness. A condition for lining the boundary line between the pixels, for a lower part of the pixel marked in black exceeding the threshold value or the maximum value, in the temperature unevenness boundary detecting unit 53, and for a row that does not exceed the maximum value or the threshold value in the upper and lower pixels in the detected area, is lining at a standard position between the pixels that performed an initial setting by the standard wall position calculating unit 54 at FIG. 17.

In the thermal image data, a coordinate point (X, Y) of each element drawn at a lower part of the boundary line is transformed by a floor coordinate transforming unit 55 as a floor coordinate point which is projected to the floor 18 as shown in FIG. 21. One can understand that element coordinates drawn at the lower part of the boundary line 60 for 94 rows are projected as a result.

FIG. 22 illustrates the area of the pixels targeted for detecting the temperature difference around the position of the frontal wall 19 under the initial setting condition for the remote controller central installation condition, at the capacity of 2.2 kw.

In FIG. 21 where a boundary line element coordinate of each thermal image data is projected to the floor 18, FIG. 23 shows a result of calculating the wall position between the frontal wall 19 and the floor 18 by calculating an average of scattering element coordinate point for each element that detects a vicinity of the frontal wall 19 position shown in FIG. 22.

Based on the similar way of thinking as the method of lining the frontal wall boundary, the boundary line is drawn based on the average of the scattering element coordinate point for each element corresponding to the right wall 17 and the left wall 16. Then, an area connected by a left wall boundary line 20, a right wall boundary line 21, and a frontal wall boundary line 22 becomes the floor area.

Also, as a method of lining the floor wall boundary line with a good precision based on the temperature unevenness detection, there is also a method of recalculating an average value based only on an element target in which $\sigma$ value is below the threshold value, by calculating a standard deviation $\sigma$ and the average value of the element coordinate Y for the region where a frontal wall boundary line is calculated in FIG. 22.

Likewise, in the left and right wall boundary line calculation, it is also possible to use the standard deviation $\sigma$ and the average value of coordinate X for each element.

Also, as an another method of calculating the left and right wall boundary line, there is also a method of calculating the boundary line between the left and right walls by using an average of Y coordinate calculated by the frontal wall boundary line calculation, in other words, an average of X coordinates of each element distributed on the intermediate area ⅓ to ⅔ in the Y coordinate distance, in respect to the distance from the wall which is the air conditioner 100 installation side. There is no problem for either cases.

A detection log accumulating unit 57 integrates the distance Y to the frontal wall 19 having an installation position of the air conditioner 100 as an origin, a distance X_left to the left wall 16, and a distance X_right to the right wall 17, that are calculated by the frontal and right and left walls position calculating unit 56 based on the above method, as a total sum of each distance, at the same time, integrates a number of counts as a distance detection counter, and an averaged distance is calculated by dividing the total sum of the detected distance and a count number. Similar measures are used in calculating for the left and right walls.

The detected result of the room shape based on the temperature unevenness is valid only when a number of detection times counted by the detection log accumulating unit 57 is greater than a number of threshold times.

Next, a calculation method of "(3) the room shape calculated by the human body detection position log" will be described. FIG. 24 shows a flow for calculating the room shape based on the human body detection position log. The human body detecting unit 61 has a characteristic of determining the human position by taking a difference between a thermal image data immediately before and a thermal image data of vertical 8×horizontal 94 generated as a thermal image data by the infrared image acquiring unit 52, based on the output of the infrared sensor driving unit 51 that drives the infrared sensor 3.

The human body detecting unit 61 that detects a position of the human body and that detects a presence of the human body is characterized in separately having a threshold value A allowing a difference detection around a head portion of the human having a relatively high surface temperature, and a threshold value B allowing a difference detection of a leg portion which is slightly low in temperature, in case of acquiring the difference in the thermal image data.

FIG. 25 determines the human detection with the threshold value A and the threshold value B by working out a difference between a thermal image data of the background image immediately before and a thermal image data where the human is present. A difference area of the thermal image data exceeding the threshold value A is determined as the head portion of the human body. A thermal image difference area exceeding the threshold value B, which adjoins the area worked out by the threshold value A, is calculated. At this time, an assumption is made that the difference area calculated by the threshold value B adjoins the difference area worked out by the threshold value A. In other words, the difference area that only exceeded the threshold value B is not determined as the human body. A relation of the difference threshold values between the thermal image data is: threshold value A>threshold value B.

The human body area calculated based on this method allows the detection of the human body from the head portion to the leg portion. A human body position coordinate (X, Y) is determined, with thermal image coordinates X and Y for a central portion of a lowermost portion of the difference area indicating the leg portion of the human body.

It is characterized in that the human body position log accumulating unit 62 accumulates the human body position logs, via the floor coordinate transforming unit 55 that transforms the human body position coordinate (X, Y) of the leg portion worked out from the difference in the thermal image data, as the floor coordinate point shown in FIG. 21 which is described at the time of detecting the temperature unevenness.

FIG. 26 shows the state of integrated count of the human body detection position worked out from the difference in the thermal image data as the human position coordinate point (X, Y) performing the coordinate transformation by the floor coordinate transforming unit 55, for each X axis and Y axis. In the human body position log accumulating unit 62, as shown in FIG. 26, an area of 0.3 m each is secured as a minimal division of the X coordinate in the horizontal direction and the Y coordinate in the depth direction. The position coordinate (X, Y) generated for each human position detection is applied to the area secured at 0.3 m interval for each axis, and counted.

Based on the human body detection position log information from the human body position log accumulating unit 62, a wall position determining unit 58 calculates the room shape including the floor 18 and the walls (the left wall 16, the right wall 17, and the frontal wall 19).

FIG. 27 shows the determined result of the room shape based on the human body position log. It is characterized in determining that an area range of an upper 10% of maximum accumulation value accumulated on the X coordinate in the horizontal direction and the Y coordinate in the depth direction as the floor area.

Next, an example of accurately calculating the room shape, by estimating whether the room shape is rectangular (square) or L-shaped, based on the accumulated data of the human body detection position log, and by detecting the temperature unevenness in the vicinity of the floor 18 and the walls (the left wall 16, the right wall 17, and the frontal wall 19) for the L-shaped room.

FIG. 28 shows the result of the human body detection position log for a L-shaped living room. An area of 0.3 m each is secured as a minimal division of the X coordinate in the horizontal direction and the Y coordinate in the vertical direction. The position coordinate (X, Y) generated for each human position detection is applied to the area secured at 0.3 m interval for each axis, and counted.

As a mater of course, the human moves inside the L-shaped room, so that count numbers accumulated on the floor area in the horizontal direction (i.e., X coordinate) and a floor area in the depth direction (i.e., Y coordinate) are proportional to a depth area (square measure) for each X and Y coordinate.

The method of determining whether the room shape is rectangular (square) or L-shaped, based on the accumulated data of the human body detection position log will be described.

FIG. 29 shows the count number accumulated to the floor area (X coordinate), in the horizontal direction X-coordinate. The threshold value A is characterized in determining that an upper 10% of the maximum accumulation value accumulated, as a distance of the floor in X direction (the breadth).

The method is characterized in that, as shown in FIG. 30, the floor area calculated in FIG. 29 (X coordinate) is divided into equal three portions of area A, area B, and area C, in order to find which area the maximum accumulation value is present. At the same time, a maximum value and a minimum value per each area are calculated.

The room shape is determined as L-shape, provided that the maximum accumulation value is present in the area C (or the area A), a difference between the maximum value and the minimum value within the area C is no more than $\Delta\alpha$, and a difference between the maximum accumulation value of the area C and the maximum accumulation value of the area A is no less than $\Delta\beta$.

The calculation of the difference $\Delta\alpha$ between the maximum value and the minimum value for each area is one of the noise debounce process for estimating the room shape based on the accumulated data of the human body detection position log. As shown in FIG. 31, there is also a method for determining from that no less than $\gamma$ number (the number inside the area divided for every 0.3 m) of an upper 90% of the count number of the maximum accumulation number is present, when the maximum accumulation number of the accumulated data is present inside the area C. After implementing the calculation of the area C, a similar calculation is performed for the area A, thereby determining the room shape as L-shaped (see FIG. 32).

When the room shape is determined as L-shape as described above, as shown in FIG. 33, locations with an upper 50% of the maximum accumulation number are worked out. The present description is described with X coordinate in the horizontal direction, however, the case is similar for the accumulated data of the Y coordinate in the depth direction.

It is characterized in that a coordinate point that regards the threshold value B of no less than 50% for the maximum accumulation number in the floor area of the Y coordinate in the depth direction Y and the X coordinate in the horizontal direction as a boundary, is determined as a boundary point between the floor and the wall of the L-shaped room.

FIG. 34 shows the floor area shape for the L-shaped room worked out based on the boundary point between the floor and the wall of the L-shaped room calculated in FIG. 33, and the X coordinate and Y coordinate of the floor area which is no less than the threshold value A.

It is characterized in performing a feedback of the L-shaped floor shape result calculated as above to the standard wall position calculating unit 54 in terms of the temperature unevenness room shape algorithm, and in recalculating a range for performing the temperature unevenness detection on the thermal image data.

A method for integrating three information that calculate the room shape is described next. However, the processes for performing the feedback of the L-shaped floor shape result calculated to the standard wall position calculating unit 54 in terms of the temperature unevenness room shape algorithm, and for recalculating the area for performing the temperature unevenness detection on the thermal image data are omitted herein.

FIG. 35 shows the flow for integrating the three information. An determined result of "(2) a room shape worked out based on the temperature unevenness of the floor 18 and the walls occurring during the operation of the air conditioner 100" is validated by the temperature unevenness validity determining unit 64, only when the number of detection times counted by the detection log accumulating unit 57 at the temperature unevenness boundary detecting unit 53 is greater than the number of threshold times.

Likewise, a room shape calculated by a human body position log accumulating unit 62 in accordance with "(3) a room shape calculated by the human body detection position log", also, performs a decision based on the following condition by the wall position determining unit 58, under a presumption of validating the determination result of the room shape based on the human body detection position log, by the human body position validity determining unit 63, only when a number of human body detection position log times that accumulates the human body position log by the human body position log accumulating unit 62 is greater than the number of threshold times.

A. When (2) and (3) are both invalid, an initial setting value calculated based on the capacity zone of the air conditioner 100 and the remote controller installation position button setting as in (1) is taken as the room shape.

B. When (2) is valid and (3) is invalid, a result output based on (2) is taken as the room shape. However, when the room shape of (2) does not settle within the lengths or the area determined in (1) of FIG. 12, it is enlarged or decreased within that range. However, in case of enlarging or decreasing based on the area, it is corrected with a distance to the frontal wall 19.

A specific correction method will be described. FIG. 36 shows the result of the room shape based on the temperature unevenness detection, at the remote controller central installation position condition, and the capacity of 2.8 kw. Referring to FIG. 12, the length and breadth have the minimum value of 3.1 m, and the maximum value of 6.2 m, for the capacity of 2.8 kw of the air conditioner 100. For this reason, a distance limitation from the remote controller central installation condition, to the right side wall, which is a distance Y_right, and to the left side wall, which is a distance X_left, are halved of those in FIG. 12. For this reason, the distance of the right wall minimum/left wall minimum shown in the drawing is 1.5 m, the distance of the right wall maximum/left wall maximum is 3.1 m. As the room shape based on the temperature unevenness shown in FIG. 35, when the distance to the left wall 16 exceeds the left wall maximum distance, it is reduced to a position of the left wall maximum as shown in FIG. 37.

Similarly, as shown in FIG. 36, when a distance to the right wall positions in between the right wall minimum and the right wall maximum, the position relationship is maintained intact. An area of the room shape is calculated after decreasing to the left wall maximum as shown in FIG. 37, and confirms whether it is within a reasonable range of the area range of 13 to 19 $m^2$ for the capacity 2.8 kw shown in FIG. 12.

Suppose that the room shape area of FIG. 37 after the correction is large, exceeding the area maximum value of 19 $m^2$, then a distance of the frontal wall 19 is decreased until attaining the maximum area 19 $m^2$, as shown in FIG. 38.

Similarly, the case shown in FIG. 39, when a distance to the left wall 16 does not attain the left wall minimum, it is enlarged to the left wall minimum area.

After that, as shown in FIG. 40, it determines whether it is within the appropriate area by calculating the room shape area after the correction.

C. When (2) is invalid and (3) is valid, an output result of (3) is taken as the room shape. Similar to the case of B, which is when (2) is valid, and (3) is invalid, the correction is performed to suit the limitation of the area and the lengths determined in (1).

D. When both (2) and (3) are valid, the output of "(2) the room shape based on the temperature unevenness" is corrected by narrowing to a maximum breadth of no more than 0.5 mm, when the room shape based on "(3) the room shape based on the human body detection position log" has a narrower distance to the wall than "(2) the room shape based on the temperature unevenness" being the standard.

In reverse, the correction is not performed when (3) is wider. Also, in regard to the room shape after the correction, the correction is added to suit the lengths and the area limitations determined in (1).

Based on the integral conditions stated above, each wall to wall distance as shown in FIG. 41, including a distance of Y coordinate Y_front to the frontal wall 19, an X coordinate X_right to the right wall 17, and an X coordinate X_left to the left wall 16, can be calculated.

Next, a floor and wall radiation temperature calculation will be described. FIG. 42 (FIG. 5) is a drawing that projects in reverse each coordinate point on the floor boundary line calculated based on the respective distances between the left and right walls (the left wall 16 and the right wall 17) and the frontal wall 19 calculated under the integral conditions stated above, onto the thermal image data.

One can see the state of dividing the area into an area of the floor 18, and areas of the frontal wall 19, the left wall 16, and the right wall 17, on the thermal image data of FIG. 42.

To begin with, in regard to the wall temperature calculation, an average of the temperature data calculated by the thermal image data of each wall area calculated on the thermal image data is taken as the wall temperature.

As shown in FIG. 43, areas encircled in thick lines on each wall area becomes the respective wall areas.

Next, the temperature area of the floor 18 will be described. The floor area on the thermal image data, for example, is divided into small portions having a total areas of 15 divisions, including 5 area divisions in the left and right direction, and 3 divisions in the depth direction. Further, a number of divided areas is not limited to this. The number can be arbitrary.

An example shown in FIG. 44 divides into 5 area divisions in the left and right direction (A1, A2, A3, A4, and A5) with respect to a near side area of the floor 18.

Similarly, FIG. 45 divides into 3 area divisions (B1, B2 and B3) front and back with respect to the far side area of the floor. Any one of them is characterized in that the floor area of the front, back, left and right are overlapping for each area. Accordingly, on the thermal image data, temperature data of the floor temperature in 15 divisions, as well as the temperatures of the front wall 19, the left wall 16, and the right wall 17 are generated. The temperature of each floor area divided is set as the respective average temperature. It is characterized in calculating the radiation temperature of each human body within the living area photographed by the thermal image data, based on each temperature information divided into areas on this thermal image data.

The radiation temperature for each human body, based on the walls and the floor, is calculated by using the equation shown below.

$$\text{T_calc} = Tf.ave + \frac{1}{\alpha}\left[\frac{\text{T_left} - Tf.ave}{1 + (Xf - \text{X_left})^2}\right] + \frac{1}{\beta}\left[\frac{\text{T_front} - Tf.ave}{1 + (Yf - \text{Y_front})^2}\right] + \frac{1}{\gamma}\left[\frac{\text{T_right} - Tf.ave}{1 + (Xf - \text{X_right})^2}\right] \quad \text{[Equation 1]}$$

Where

T_calc: radiation temperature

Tf. ave: floor temperature where the human body is detected

T_left: left wall temperature

T_front: frontal wall temperature

T_right: right wall temperature

Xf: X coordinate of human body detected position

Yf: Y coordinate of human body detected position

X_left: distance to the left side wall

Y_front: distance to the frontal side wall

X_right: distance to the right side wall $\alpha$, $\beta$, $\gamma$: correction coefficients The radiation temperature calculation that considered effects of the floor temperature, the wall temperature of each wall, and the distance to each wall, can be executed at a location where the human body is detected.

An example of the radiation temperature calculated by using the above equation is shown in FIG. 46. The radiation temperature is calculated in trial under the conditions in which a subject A and a subject B have been detected on a thermal image data within a living space photographed on the thermal image data. As a result of calculation with the front wall temperature T_front=23° C., the T_left=15° C., the T_right=23° C., the floor temperature of subject A Tf. ave=20° C., the floor temperature of subject B Tf. ave=23° C., and the correction coefficients on the radiation temperature calculation equation are all 1, the radiation temperature of subject A Tcalc=18° C., and the radiation temperature of subject B Tcalc=23° C. can be calculated.

Conventionally, the radiation temperature is calculated based on the temperature of the floor 18 only, however, it becomes possible to consider the radiation temperature based on the wall temperature which is calculated by recognizing the room shape, making it capable of calculating the radiation temperature perceived by an entire body of the human.

Next, an example of detecting the curtain open and close state by using the wall temperatures calculated by recognizing the above-described room shape will be described. In the air-conditioned room, in many cases, the air conditioning efficiency will be better of when the curtain is closed rather then a curtain open state, therefore, it attempts to urge the user of the air conditioner 100 to close the curtain when the curtain open state has been detected.

Referring to the flowchart of FIG. 47, the flow for detecting the curtain open and close state will be described.

Further, the control shown below is performed by the microcomputer having programmed with a prescribed operation. Herein, the microcomputer having programmed with a prescribed operation is defined as a control unit. In the description below, the description that the respective controls are performed by the control unit (the microcomputer having programmed with a prescribed operation) is omitted.

A thermal image acquiring unit 101 acquires the thermal image by detecting the temperature of the temperature detection target with the infrared sensor 3 scanning the temperature detection target area from right to left.

As described already, when acquiring the thermal image data of the walls and the floor of the room, the stepping motor 6 moves the infrared sensor 3 in the right and left direction, and stops the infrared sensor 3 for a prescribed time (0.1 to 0.2 seconds) at each position of 1.6 degrees of the movable angle of the stepping motor 3 (the rotation drive angle of the infrared sensor 3). After the infrared sensor 3 is stopped, it waits for a prescribed time (a time interval shorter than 0.1 to 0.2 seconds), and incorporates the detected result (the thermal image) of the eight light receiving elements of the infrared sensor 3. After finishing incorporation of the detected result of the infrared sensor 3, the stepping motor 6 is driven (the movable angle 1.6 degrees) and stopped again, and incorporates the detected result (the thermal image) of the eight light receiving elements of the infrared sensor 3 based on the same operation. The above operation is repeatedly performed, and the thermal image data within the detected area is calculated based on the detected result of the infrared sensor 3 for 94 locations in the right and left direction.

The floor and wall detecting unit 102 calculates a floor dimension of the air conditioning area, wherein the previously-described control unit scans with the infrared sensor 3 and acquires a wall area (the wall position) inside the air conditioning area on the thermal image data, by integrating the three information shown below on the thermal image.

(1) a room shape having the initial setting value and the room shape limitation value, which is calculated based on the capacity zone of the air conditioner 100 and the remote controller installation position button setting;
(2) a room shape calculated based on the temperature unevenness of the floor and the walls occurring during the operation of the air conditioner 100; and
(3) a room shape calculated based on the human body detection position log.

Based on the thermal image acquired in the thermal image acquiring unit 101, by applying, a process of the temperature condition determining unit (a room temperature determining unit 103 and an outside temperature determining unit 104) which will be described below, to the background thermal image (FIG. 43) generated in the previously-described process, it determines whether or not the current temperature condition is in a state of requiring a detection of the window condition.

The state of requiring the detection of the window condition means that the outdoor temperature is lower than a fixed temperature (for example, 5° C.) with respect to the room temperature, and the window is cooled down, indicating a poor heating efficiency at the curtain open state.

In reverse, during the cooling, the outdoor temperature is higher than a fixed temperature (for example, 5° C.) with respect to the room temperature, and the window is warmed up, indicating a poor cooling efficiency at the curtain open state.

The room temperature determining unit 103 of the temperature condition determining unit is a method for detecting the room temperature. The room temperature can be roughly estimated by using the methods indicated below.

(1) an average temperature of the entire image of the background thermal image;
(2) an average temperature of the floor area of the background thermal image; and
(3) a value of the room temperature thermister (not illustrated) loaded on the air suction port 41 of the indoor unit chassis 40 (the main body) of the air conditioner 100.

The outside temperature determining unit 104 is a method for detecting the outside temperature. The outside temperature is roughly estimated by using the methods indicated below.

(1) a value of the outside temperature thermister (not illustrated) on the outdoor unit (not illustrated) of the air conditioner 100; and
(2) the following methods may be substituted without causing a trouble in determining whether the detection of window state is required or not.
a. (during the heating operation) an area having the lowest temperature in the wall area of the background thermal image;
b. (during the cooling operation) an area having the highest temperature in the wall area of the background thermal image.

When a difference between the outside temperature and the room temperature detected by the outside temperature determining unit 104 and the room temperature determining unit 103 is no less than a prescribed value (for example, 5° C.), then the process is advanced to a window condition determining unit as follows.

In the window condition determining unit, an area having a prominent temperature difference in the background thermal image (a predetermined temperature difference, for example, 5° C.) is detected as the window area 31 (see FIG. 48). At the same time, it is capable of detecting a curtain closing operation by monitoring a change in the window area 31 with time.

For example, when the infrared sensor 3 photographs an indoor temperature distribution during the heating operation, then the thermal image shown in FIG. 48 is obtained. A low temperature portion on the right wall in the thermal image is detected as the window area 31. In FIG. 48, highs and lows of the temperature are expressed by a depth of color. The darker the color, the lower the temperature.

In a wall area temperature difference determining unit 105, it determines whether or not a temperature difference in the wall area of the background thermal image is no less than a prescribed value (for example, 5° C.). The temperature difference in the wall area changes depending on the heating operation, the cooling operation, the room size, and a time elapse after the start of air conditioning, however, in many cases, there is a difference in the wall temperature with respect to the standard temperature such as a floor temperature or a room temperature during the air conditioning, and it is difficult to determine for a presence/absence of the window area 31 simply from a threshold value processing which is based on the difference with the standard temperature.

Then, in the wall area temperature difference determining unit 105, if there is a prominent difference in temperature in the same wall, it determines for the presence/absence of the temperature difference in the wall area, based on a notion that the window area 31 is present.

In case that there is no prominent temperature difference in the wall area in the wall area temperature difference determining unit 105, it determines that there is no window area 31, and the later processes are not performed.

In a wall area outside temperature area extracting unit 106, an area close to the outside temperature in the wall area of the background thermal image is extracted. That is, an area of high temperature in the wall area is extracted during the cooling operation, and an area of low temperature in the wall area is extracted during the heating operation.

As an extraction method for an area which is close to the outside temperature in the wall area of the background thermal image, there is a method of extracting a high (low) area that is no less than the prescribed temperature (for example, 5° C.), with respect to an average temperature of the wall area.

However, in the wall area outside temperature area extracting unit 106, a minute area is deleted as erroneous detection. For example, provided that a minimum size of the window is breadth 80 cm×height 80 cm. A size of the window on the thermal image can be calculated in case that there is a window at each position on the thermal image, based on a setting angle of the infrared sensor 3 and the positions of the walls and the floor detected by the floor and wall detecting unit 102. When the window size on the thermal image calculated by this calculation is less than the minimum size of the window, it is deleted as being the minute area.

In a window area extracting unit 107, an area having a high probability of being the window area 31 among the areas extracted by the wall area outside temperature extracting unit 106 is extracted.

The window area extracting unit 107 detects an area continuously extracted by the wall area outside temperature area extracting unit 106 as the window area 31 for more than a prescribed time (for example, 10 minutes) as the window area 31.

A window area temperature determining unit 108 monitors the change of temperature in areas detected as the window area 31 by the window area extracting unit 107, determines whether the temperature of the area determined as the window has changed close to the average wall temperature, and determines that the window area 31 is no longer present if there is a change.

A curtain closing operation determining unit 109 determines that the curtain has been closed if all of the window area 31 detected by the window area extracting unit 107 have been determined as not the window area 31 in the window area temperature determining unit 108.

Also, in a state of being detected the window area 31 by the window area extracting unit 107, the wall area temperature difference determining unit 105 determines that the curtain has been closed even if it determines that the window area 31 is not present.

As described above, the thermal image acquiring unit 101 acquires the thermal image by detecting the temperature of the temperature detection target as a result of scanning with the infrared sensor 3 the temperature detection target area from right to left. The floor and wall detecting unit 102 acquires the wall area in the air conditioning area on the thermal image data. The window condition determining unit determines whether or not the current temperature condition is a state which require detection of the window state. If it is in the state of requiring the detection, the window condition determining unit detects an area having a prominent temperature difference within the background thermal image as the window area 31, at the same time, it is capable of detecting the curtain close operation by monitoring the change in the window area 31 with time.

With this structure, it becomes possible to detect an exposure of the window receiving an influence of the outside temperature, being a state of requiring excessive electricity consumption during the air conditioning, making it capable of urging the user of the air conditioner 100 to close the curtain or the like.

The user of the air conditioner 100 may reduce the electricity consumption by closing the curtain or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

In the air conditioner according to the present invention, a control unit acquires a thermal image data of a room by scanning with an infrared sensor, calculates a floor dimension of an air conditioning area by integrating three information indicated below, and acquires wall positions in the air conditioning area on the thermal image data;

(1) a room shape having the initial setting value and the shape limitation value, which is calculated based on the capacity zone of the air conditioner and the remote controller installation position button setting;

(2) a room shape calculated based on the temperature unevenness of the floor and walls occurring during the operation of the air conditioner; and (3) a room shape calculated based on a human body detection position log. In this way, areas of floor and walls can be seen on the thermal image data, making it possible to calculate an average temperature of the individual walls, and to accurately calculate a temperature perceived by a human body detected on the thermal image that takes into account of the wall temperatures.

What is claimed is:

1. An air conditioner, comprising:

a substantially box-shaped main body having an air suction port that sucks air of a room and an air outlet port that discharges conditioned air;

an infrared sensor attached to a front of the main body at a prescribed downwardly facing depression angle that detects a temperature of a temperature detection target by scanning a temperature detection target area from right to left; and a control unit that controls the air conditioner by detecting a presence of human or heat generating device with the infrared sensor; and wherein the control unit acquires a thermal image data of the room by scanning with the infrared sensor, calculates on the thermal image data a floor dimension of an air conditioning area by integrating three information indicated below, and calculates wall positions in the air conditioning area on the thermal image data;

(1) a room shape having a shape limitation value and an initial setting value, which is calculated based on a capacity zone of the air conditioner and a remote controller installation position button setting;

(2) a room shape calculated based on a temperature unevenness of the floor and walls occurring during an operation of the air conditioner; and (3) a room shape calculated based on a human body detection position log.

2. The air conditioner according to claim 1, wherein the control unit validates "(2) a room shape calculated based on a temperature unevenness of the floor and walls occurring during an operation of the air conditioner" when a number of detection times is greater than a prescribed number of threshold times, validates "(3) a room shape calculated based on a human body detection position log" when a number of human body detection position log times accumulating a human body position log is greater than a prescribed number of threshold times, calculates the floor dimension of the air conditioning area by integrating the three information, and calculates the wall positions in the air conditioning area on the thermal image data, in accordance to the following conditions:

A. When both (2) and (3) are invalid, "(1) a room shape having a shape limitation value and an initial setting value, which is calculated based on a capacity zone of the air conditioner and a remote controller installation position button setting" is taken as the room shape;

B. When (2) is valid and (3) is invalid, an output result of (2) is taken as the room shape;

C. When (2) is invalid and (3) is valid, an output result of (3) is taken as the room shape;

D. When both (2) and (3) are valid, the room shape of (2) is taken as a standard.

3. The air conditioner according to claim 2, as for "B" when the output result of (2) does not fit into vertical and horizontal lengths determined in (1), or does not fit into an area determined in (1), then it is enlarged or decreased to fit into a range of (1).

4. The air conditioner according to claim 3, when enlarging or decreasing based on the area, a distance to a frontal wall of the room is corrected.

5. The air conditioner according to claim 2, as for "D" when the room shape based on "(3) a room shape calculated based on the human body detection position log" has a narrower distance to the wall, the output of the room shape of (2) is corrected by narrowing to a maximum breadth of no more than 0.5 mm.

6. The air conditioner according to claim 1, wherein the control unit generates a temperature data of the floor and each wall based on the thermal image data by projecting in reverse on the thermal image data each coordinate point on a floor boundary line calculated based on the wall position within the air conditioning area on the thermal image data and the floor dimension within the air conditioning area calculated by integrating the three information, and calculates a radiation temperature of the human body based on the temperature data.

7. The air conditioner according to claim 6, wherein the calculation for each wall temperature takes an average of the temperature data calculated based on the thermal image data of each wall area calculated on the thermal image data as each wall temperature.

8. The air conditioner according to claim 6, wherein the calculation for each wall temperature divides the floor area on the thermal image data into a plurality of areas, and takes an average of the temperature data calculated based on a thermal image data of each area divided as a floor temperature of each area.

9. The air conditioner according to claim 8, wherein the floor area on the thermal image data is divided into a plurality of numbers for a horizontal direction and a depth direction, respectively.

10. The air conditioner according to claim 9, wherein the divided floor areas at front and back and right and left are overlapping with one another.

11. The air conditioner according to claim 6, wherein the radiation temperature is calculated based on each wall and floor per each human, by using an equation shown below:

$$\text{T_calc} = Tf.ave + \frac{1}{\alpha}\left[\frac{\text{T_left} - Tf.ave}{1 + (Xf - \text{X_left})^2}\right] + \frac{1}{\beta}\left[\frac{\text{T_front} - Tf.ave}{1 + (Yf - \text{Y_front})^2}\right] + \frac{1}{\gamma}\left[\frac{\text{T_right} - Tf.ave}{1 + (Xf - \text{X_right})^2}\right] \quad \text{[Equation 1]}$$

where

T_calc: radiation temperature

Tf. ave: floor temperature where the human body is detected

T_left: left wall temperature

T_front: frontal wall temperature

T_right: right wall temperature

Xf: X coordinate of human body detected position

Yf: Y coordinate of human body detected position

X_left: distance to the left side wall

Y_front: distance to the frontal side wall

X_right: distance to the right side wall

α, β, γ: correction coefficients.

12. An air conditioner, comprising:

a substantially box-shaped main body having an air suction port that sucks air of a room and an air outlet port that discharges conditioned air;

an infrared sensor attached to a front of the main body at a prescribed downwardly facing depression angle that detects a temperature of a temperature detection target by scanning a temperature detection target area from right to left; and a control unit that controls the air conditioner by detecting a presence of human or heat generating device with the infrared sensor; and wherein the control unit comprises:

a thermal image acquiring unit acquires a thermal image data by detecting a temperature of a temperature detection target by scanning with the infrared sensor a temperature detection target area from right to left;

a floor and wall detecting unit calculates a floor dimension of an air conditioning area by integrating three information indicated below, and acquires wall positions in the air conditioning area on the thermal image data acquired by the thermal image acquiring unit;

(1) a room shape having the initial setting value and the shape limitation value, which is calculated based on the capacity zone of the air conditioner and the remote controller installation position button setting;

(2) a room shape calculated based on the temperature unevenness of the floor and walls occurring during the operation of the air conditioner; and (3) a room shape calculated based on a human body detection position log;

a temperature condition determining unit decides whether or not a current temperature condition requires a window state detection; and a window condition determining unit detects an area having a prescribed temperature difference in a background thermal image as a window area, when the temperature condition determining unit determines that the detection is required.

13. The air conditioner according to claim 12, wherein the temperature condition determining unit, which comprises:

a room temperature determining unit detects an air temperature inside the room; and an outside temperature detecting unit detects an outdoor temperature.

14. The air conditioner according to claim 12, wherein the window condition determining unit, which comprises:

a wall area temperature determining unit determines whether or not there is a temperature difference inside a wall area above a fixed value, in the background thermal image;

a wall area outside temperature area extracting unit extracts an area close to an outside temperature inside the wall area, in the background thermal image; and a window area extracting unit extracts an area having a high probability of being the window area among areas extracted by the wall area outside temperature area extracting unit, and that detects an area that has been extracted as the window area for no less than a fixed time as the window area, in the wall area outside temperature area extracting unit.

* * * * *